US005795856A

United States Patent [19]

Hatano et al.

[11] Patent Number: 5,795,856

[45] Date of Patent: Aug. 18, 1998

[54] METHOD FOR PRODUCING DETERGENT PARTICLES HAVING HIGH BULK DENSITY

[75] Inventors: Koichi Hatano; Hiroyuki Yamashita; Masaaki Sakaue; Koji Toyoda; Yasuji Yamada, all of Wakayama, Japan

[73] Assignee: Kao Corporation, Tokyo, Japan

[21] Appl. No.: 716,460

[22] PCT Filed: Mar. 24, 1995

[86] PCT No.: PCT/JP95/00553

§ 371 Date: Sep. 27, 1996

§ 102(e) Date: Sep. 27, 1996

[87] PCT Pub. No.: WO95/26394

PCT Pub. Date: Oct. 5, 1995

[30] Foreign Application Priority Data

Mar. 28, 1994 [JP] Japan ..... 6-082485

[51] Int. Cl.[6] ..... C11D 11/00

[52] U.S. Cl. ..... 510/444; 264/117; 264/140

[58] Field of Search ..... 510/444; 264/117, 264/140

[56] References Cited

U.S. PATENT DOCUMENTS

| | | | |
|---|---|---|---|
| 3,277,520 | 10/1966 | Nakahara | 18/1 |
| 5,030,379 | 7/1991 | Knight et al. | 510/276 |
| 5,149,455 | 9/1992 | Jacobs et al. | 510/443 |
| 5,160,657 | 11/1992 | Bortolotti et al. | 510/444 |
| 5,415,806 | 5/1995 | Pepe et al. | 510/323 |
| 5,468,516 | 11/1995 | Yamashita et al. | 510/444 |
| 5,501,810 | 3/1996 | Eugster et al. | 510/442 |

FOREIGN PATENT DOCUMENTS

| | | |
|---|---|---|
| 0513824 | 11/1992 | European Pat. Off. . |
| 1-247498 | 10/1989 | Japan . |
| 1-311200 | 12/1989 | Japan . |
| 6-299199 | 10/1994 | Japan . |
| 1517713 | 7/1978 | United Kingdom . |
| 90/12640 | 11/1990 | WIPO . |

*Primary Examiner*—Paul Lieberman
*Assistant Examiner*—Lorna M. Douyon
*Attorney, Agent, or Firm*—Birch, Stewart, Kolasch & Birch, LLP

[57] ABSTRACT

The method for producing detergent particles having a high bulk density, the method being characterized by mixing granulated detergent particles having a bulk density of from 500 to 1,000 g/liter, while applying a shearing force to particles caused by a contact of the particles with each other in a mixer. According to the production method using a drum mixer of the present invention, it is possible to increase the bulk density of the detergent particles by 50 to 200 g/liter, wherein the granulated detergent particles or that of the granulated detergent particles subjected to a treatment of increasing bulk density by conventional methods have a bulk density of from 500 to 1,000 g/liter.

12 Claims, 4 Drawing Sheets

100 μm

100 μm

METHOD FOR PRODUCING DETERGENT PARTICLES HAVING HIGH BULK DENSITY

TECHNICAL FIELD

The present invention relates to a method for producing detergent particles having a high bulk density subjected to a treatment of increasing a bulk density.

BACKGROUND ART

The mainstream of the presently used cloth detergents is different from conventional granulated detergent particles having hollow shapes in that the granulated materials have a low void fraction in the inner portion of the granulated detergent particles by processing the powder, the detergent particles having a bulk density of from about 700 to 800 g/liter. It is desirable to further subjected to a treatment of increasing a bulk density of the granulated detergent particles for the purposes of efficiency of distribution owing to well-saved resources of the containers and well-saved spaces, and thereby making it simpler for the consumers' use.

In the production of cloth detergents, drum mixers are normally used to mix granulated detergent materials after the granulation with additives and recycled powders, which may result in a slight increase in the bulk density. However, since drum mixers and continuous drum mixers are used for the purpose of gently mixing particles in the mixers without causing breakage of the particles, the operating conditions of the mixers are accordingly set to achieve a low rotational speed expressed as a Froude number of approximately from 0.01 to 0.1 and a treatment time (mean residence time in the case of continuous drum mixers) as short as from about 3 to 10 minutes. These drum mixers are used for the purpose of mixing and not for the treatment of increasing bulk density, so that actual increase in bulk density cannot be substantially observed under normal mixing conditions.

Various techniques proposed for treatment of increasing the bulk density of granulated detergent particles are disclosed. Examples are given below by way of explanation.

1. Treatment of Increasing Bulk Density in Granulation Process

Examples of methods of treatment of increasing bulk density of granulated detergents in the granulation process include the following.

Japanese Patent Laid-Open No. 61-69897 discloses a method for producing a granular detergent having a high density and excellent flowability, comprising the step of agitating and granulating a spray-dried product of detergents containing a surfactant and a builder in the presence of a surface modifying agent and a binder using a mixer having a vertical agitator shaft in an inner portion of a vertical mixing vessel.

Japanese Patent Laid-Open No. 61-69900 discloses a method for producing a granulated detergent having a high density and improved flowability, comprising the steps of pulverizing a spray-dried product of detergents containing a surfactant and a builder, and then carrying out granulation treatment of the pulverized product in the presence of a surface modifying agent with a mixer having a horizontal agitator shaft in an inner portion of a horizontal mixing vessel. Japanese Patent Laid-Open No. 2-232299 discloses a method for increasing the density of detergent particles as well as for improving the dispersibility and solubility, comprising the steps of continuously supplying granulated detergent particles to a granulating chamber having an agitation impeller rotating in a horizontal direction; granulating the supplied detergent particles by agitation and mixing; and making the granulated detergent particles overflow from a discharging outlet arranged at a side wall of the granulating chamber, and an apparatus used therefor.

Japanese Patent Laid-Open No. 1-247498 discloses a method for increasing the density of spray-dried detergent particles comprising the steps of continuously supplying spray-dried particles to a particular cylindrical mixing drum having a rotational shaft in an inner portion thereof, and adjusting a rotational speed of the shaft so as to have a mean residence time of from 10 to 60 seconds and a Froude number of from 50 to 1200. Japanese Patent Laid-Open No. 2-286799 discloses a continuous production method, comprising the steps of treating a granulated detergent composition or components thereof using a high-speed mixer or densifier in the first step; further treating the treated composition or components thereof using a moderate-speed granulator or densifier to form in an easily deformable state in the second step; and drying and cooling the treated composition or components in the final step, wherein the powder is added in the second step or in the first step.

Also, Japanese Patent Laid-Open No. 5-209200 discloses a method for producing nonionic detergent particles having excellent flowability and non-caking properties, comprising the steps of mixing and stirring detergent materials comprising a nonionic surfactant as a main base material with a particular agitation mixer to granulate the detergent materials, and then mixing the granulated particles thus obtained with fine powder to coat the detergent materials with this fine powder.

However, in the techniques for the treatment of increasing the bulk density of the granulated detergent particles in the granulation process or the techniques of also adding fine powder, although the single particle density and the surface properties of granulated detergent particles are improved to some extent, there are many cases where the sphericity or the surface smoothness of the granulated detergent particles are insufficient. Therefore, it is desirable to further subject the granulated detergent particles to a treatment of increasing the bulk density of the granulated detergent particles obtained according to any of the above methods by improving their sphericity and surface smoothness.

2. Treatment of Increasing Bulk Density by Improving Sphericity of Granulated Particles Examples of apparatus and methods for a treatment of increasing the bulk density of the granulated detergent particles by improving sphericity of fine granules or extruded granules are exemplified by the following techniques. For instance, Japanese Patent Examined Publication No. 41-563 discloses an apparatus for increasing sphericity of granules, the apparatus comprising a rotating member with a rugged upper surface or having a planar rotating member on a bottom portion of a cylindrical granulating chamber, to allow high-speed rotations, and a side wall of the above granulating chamber being kept in a stationary state or rotated in a direction opposite to rotations of the above rotating member. Japanese Patent Laid-Open No. 51-67302 discloses a method for producing a granular detergent composition, comprising the step of treating granules obtained by forming with a non-extrusion process in a post-granulating device containing a substantially horizontal and freely rotatable rough surface table positioned in the inner portion and at the bottom portion of a vertical cylinder having smooth side wall, the post-granulating device being equipped with a substantially horizontal, circular, rotational bed. Japanese Patent Laid-Open No. 2-232300 discloses a method of continuous granulation, comprising the steps of supplying granulated detergent powder onto a rotating table having radial projections in a granulating chamber, and carrying out granulation by applying a peripheral force by the rotation in a horizontal direction of the rotating table, thereby giving the resulting granules with a high density and improving dispersibility and solubility, and an apparatus used therefor.

In the techniques for improving sphericity of fine granules or extruded granules, fine powders generated in the process of increasing sphericity have to be collected, and the processed amount relative to volume is a relatively small. Also, in the case of fine granule materials with tackiness, there arises such a problem that the adhesion to the inner wall of the cylinder is generated.

Further, as another method, Japanese Patent Laid-Open No. 62-598 discloses a method for producing a detergent composition having a high bulk density and excellent appearance, comprising the steps of making a granular detergent composition flow together with a cyclonic gas flow, the cyclonic gas flow moving along a vessel wall to bring it in contact with and collide against the wall, to have increased sphericity and(or) density of particles. In this technique, however, since a residence time of particles in the vessel is short and a relatively small force is applied onto the particles, sufficient improvements in increasing sphericity, density, and surface smoothness cannot be achieved, so that improvement in the bulk density is not sufficient in some cases.

DISCLOSURE OF THE INVENTION

Accordingly, an object of the present invention is to provide a method for producing detergent particles having a high bulk density which is even further subjected to a treatment of increasing bulk density, when compared to detergent particles subjected to treatments for increasing bulk density by conventional techniques.

As a result of continual intensive research for the purpose of increasing the bulk density of the granulated detergent particles using a rotary vessel mixer, the present inventors have found that the bulk density of the granulated detergent particles can be increased by utilizing a shearing force to particles caused by a mutual contact of the particles in the rotary vessel mixer under given conditions. The present invention has been completed based on this finding.

Specifically, the present invention is concerned with the following:

(1) A method for producing detergent particles having a high bulk density, the method being characterized by mixing granulated detergent particles having a bulk density of from 500 to 1,000 g/liter, while applying a shearing force to particles caused by a mutual contact of particles in a mixer;

(2) The production method described in item (1) above, wherein the granulated detergent particles having a bulk density of from 500 to 1,000 g/liter are supplied into a rotary vessel mixer and mixed, while applying the shearing force to the particles caused by the mutual contact of the particles in the mixer, for 5 to 120 minutes under the conditions of a Froude number of from 0.2 to 0.7 and a volume packing fraction of from 15 to 50%, the Froude number being defined by an equation given below:

$$Fr=V^2/(R\times g)$$

(Here, Fr stands for a Froude number; V stands for a peripheral speed of the outermost circumference of the rotary vessel mixer [m/s]; R stands for a radius from a center of rotation of the outermost circumference of the rotary vessel mixer [m]; and g stands for a gravitational acceleration [m/s$^2$]);

(3) The production method described in item (1) above, wherein a main component of a surfactant blended in the granulated detergent particles is a nonionic surfactant or an anionic surfactant;

(4) The production method described in item (3) above, wherein the content of the nonionic surfactant is from 5 to 60% by weight of the granulated detergent particles;

(5) The production method described in item (3) above, wherein the content of the anionic surfactant is from 5 to 60% by weight of the granulated detergent particles;

(6) The production method described in item (3) above, wherein the granulated detergent particles containing an anionic surfactant as a main component of the surfactant are heated to a temperature of not less than 35° C. and mixed, while applying a shearing force;

(7) The production method described in item (2) above, wherein the detergent particles having a high bulk density are continuously produced by continuously supplying the granulated detergent particles to the rotary vessel mixer;

(8) The production method described in item (2) above, wherein the rotary vessel mixer is equipped with agitation impellers in an inner portion thereof, a rotational radius of the agitation impellers being not more than 0.8 times a rotational radius of the rotary vessel mixer, and wherein agitation is carried out at a tip end speed of the agitation impellers of from 1 to 6 m/s;

(9) The production method described in item (1) above, wherein fine particles of which primary particles have an average particle size of not more than 10 μm are added in an amount of from 0.1 to 10.0 parts by weight, based on 100 parts by weight of the granulated detergent particles;

(10) The production method described in item (1) above, wherein a surface smoothness factor of the granulated detergent particles is not more than 70% of an initial surface smoothness factor thereof;

(11) The production method described in item (2) above, wherein the rotary vessel mixer is equipped with plural partition plates arranged perpendicular to the center line of rotation of the vessel, the partition plates being attached in the direction of the center line of rotation;

(12) The production method described in item (8) above, wherein the agitation impellers are rod-shaped impellers or plate-like impellers, the agitation impellers being arranged in parallel to the center line of rotation of the rotary vessel mixer; and

(13) The production method described in item (2) above, wherein the rotary vessel mixer is a drum mixer.

BEST MODE FOR CARRYING OUT THE INVENTION

1. Granulated Detergent Particles

Figure 1A:
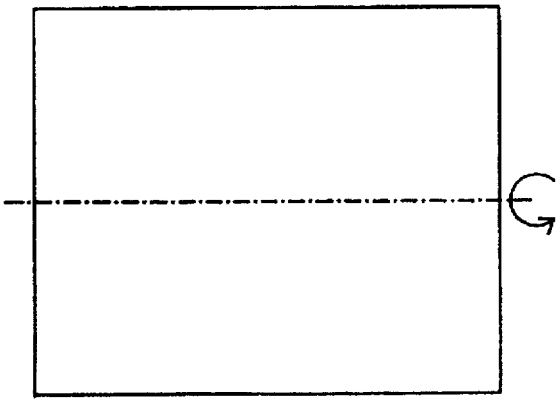
FIG. 1 is a schematic view showing a moving state of granulated detergent particles produced in a drum mixer when rotating the drum mixer.

The granulated detergent particles used in the present invention are not particularly limited, and any of the known ones usually employed may be used as long as they have a bulk density of from 500 to 1000 g/liter, more preferably from 600 to 950 g/liter.

The surfactants, which are components constituting the granulated detergent particles described above, are not particularly limited as long as they give characteristics of plastic deformation to the obtained granulated detergent particles and they can generally be mixed with detergents, with a preference given to nonionic surfactants and anionic surfactants. The term "main component of surfactant" in the present invention refers to a component of the greatest content in the surfactant. For example, in the case of granulated detergent particles containing both a nonionic surfactant and an anionic surfactant, the main component of the surfactant refers to a surfactant of a greater weight.

The nonionic surfactants and the anionic surfactants are not particularly limited, and those generally used as detergent compositions are included.

Particularly, since most of the anionic surfactants are generally thermoplastic, when heat is applied to granulated detergent particles including such anionic surfactants as a main component of the surfactant, the deformation of the particles is likely to be caused. Therefore, improvements in surface smoothness and sphericity are easily progressed, thereby raising the rate of increase in bulk density. Accordingly, when the granulated detergent particles having an anionic surfactant as the main component of the surfactant is subjected to a treatment of increasing the bulk density in the production method of the present invention, the granulated detergent particles are preferably heated to a temperature not less than the temperature at which the particles display plastic properties.

Although the temperature is not particularly limited, it is generally not less than 35° C., preferably not less than 40° C., and more preferably not less than 45° C. The upper limit of the temperature is not particularly restricted as long as it is a temperature at which the granulated detergent particles are deformable. From a practical viewpoint and a viewpoint of stability of other components, the upper limit is not more than 150° C., and preferably not more than 95° C. Heat may be applied to the granulated detergent particles prior to supplying the granulated detergent particles to a mixer, or alternatively, heating may be carried out in the mixer. Also, the granulated detergent particles may be heated to a given temperature by maintaining the granulated detergent particles at the constant given temperature in the mixer or by varying temperatures therein. Particularly, by treating the granulated detergent particles of a high temperature immediately after production for increasing the bulk density, the bulk density of the particles can be more effectively increased.

In the case of producing granulated detergent particles containing a nonionic surfactant as a main component of the surfactant, the heat treatment may or may not be conducted. However, in the case where the granulated detergent particles contain an anionic surfactant, a heat treatment is preferably carried out. The conditions of the heating treatment such as temperature are similar to the conditions for the granulated detergent particles containing an anionic surfactant as a main component of the surfactant. In particular, in the case of granulated detergent particles containing a nonionic surfactant in the form of liquid or paste at an ambient temperature as a main component of surfactant, the particle strength is low, and the plastic deformation is easily caused, so that the heat treatment does not generally have to be conducted.

Therefore, as for the granulated detergent particles to be subjected to a treatment of increasing the bulk density in the present invention, the granulated detergent particles containing a nonionic surfactant as a main component of the surfactant can be more easily implemented than the granulated detergent particles containing an anionic surfactant as a main component of surfactant.

The content of the granulated detergent particles containing a nonionic surfactant as a main component of the surfactant is not particularly limited, and the content is preferably from 5 to 60% by weight, more preferably from 5 to 50% by weight, still more preferably from 10 to 50% by weight, and particularly preferably from 10 to 40% by weight. From the viewpoint of preventing a decrease in detergency due to deficiency in the amount of the surfactant, the content is preferably not less than 5% by weight. From the viewpoint of maintaining favorable powder properties, especially in flowability, the content is preferably not more than 60% by weight.

The content of an anionic surfactant added to the granulated detergent particles containing an anionic surfactant as a main component of surfactant is not particularly limited, and the content is preferably from 5 to 60% by weight, more preferably from 5 to 50% by weight, still more preferably from 10 to 50% by weight, and particularly from 20 to 50% by weight. From the viewpoint of preventing a decrease in detergency due to deficiency in the amount of the surfactant, the content is preferably not less than 5% by weight. From the viewpoint of preventing a decrease in the content of a builder having alkaline capacity and ion exchange capacity, the content is preferably not more than 60% by weight.

In the case where both the nonionic surfactant and the anionic surfactant are contained in the granulated detergent particles, a quantitative relation of these surfactants is not particularly limited as long as each of the contents satisfies the ranges mentioned above. Any known substances usually included in granulated detergent particles may suitably be added to the particles as other components which constitute the granulated detergent particles. The contents of these additives are not particularly limited as long as these are not contradictory to the content of the surfactant specified as above.

Although the average particle size of the granulated detergent particles which are subjected to a treatment of increasing the bulk density is not particularly limited, the average particle size is generally in the range of from 200 to 1200 μm, preferably in the range of from 300 to 800 μm. From the viewpoint of lowering the amount of fine powder interfering with an increase in bulk density, the average particle size is preferably not less than 200 μm. From the viewpoint of reducing the size of the voids among the granulated detergent particles and thereby effectively achieving a high bulk density, the average particle size is preferably not more than 1200 μm.

2. Method for Producing Granulated Detergent Particles

Next, typical methods for producing granulated detergent particles containing a nonionic surfactant as a main component of the surfactant, the granulated detergent particle being subjected to a treatment of increasing bulk density, are given below. Although the methods are not particularly limited, the following methods may be, for instance, used to produce granulated detergent particles having a bulk density of from 500 to 1,000 g/liter.

(1) A method comprising the steps of preparing base material beads of a builder by spray-drying, and making the base material beads hold a nonionic surfactant (For instance, Japanese Patent Examined Publication No. 60-21200).

(2) A method comprising the steps of hydrating and wetting a builder, stirring the hydrated and wetted builder in a sealed vessel, and then impregnating the builder with a nonionic surfactant (For instance, Japanese Patent Examined Publication No. 61-21997).

(3) A method comprising the steps of forming a zeolite agglomerate from a zeolite and a filler together with a binder containing water using a device for forming agglomeration, forming a detergent agglomerate of detergent components containing the above agglomerate and a surfactant, and drying the resulting detergent agglomerate (For instance, Japanese Patent Laid-Open No. 3-26795).

(4) A method comprising the steps of uniformly kneading a nonionic surfactant and a builder to form a solid detergent, and pulverizing the solid detergent (For instance, Japanese Patent Laid-Open No. 62-263299).

(5) A method comprising the steps of mixing an aqueous powder granulated material and a silica powder, spraying a nonionic surfactant to the above mixture, and then adding fine particles thereto (For instance, Japanese Patent Laid-Open No. 61-89300).

(6) A method comprising the steps of granulating by tumbling a mixed solution of a nonionic surfactant and a fatty acid, an alkali builder, etc. in an agitation mixer while increasing bulk density; and mixing the resulting granulated product and fine powder to coat the surface of the granulated product with the fine powder (For instance, Japanese Patent Application No. 6-211929).

(7) A method comprising the steps of stirring and mixing detergent starting materials containing a nonionic surfactant as a main component of the surfactants in an agitation mixer; granulating the detergent starting materials by forming an adhesion layer of the detergent starting materials on the wall of the agitation mixer while increasing bulk density of the detergent starting material using an agitation impeller; and mixing the resulting granulated product and fine powder to coat the surface of the granulated product with the fine powder (For instance, Japanese Patent Laid-Open No. 5-209200).

By using the above methods, the granulated detergent particles containing a nonionic surfactant as a main component of the surfactant and having a bulk density of 500 to 1,000 g/liter can be obtained. Particularly when the method according to item (6) or (7) is used, since the granulated detergent particles and having a high bulk density and being plastically easily deformable can be obtained, the treatment of increasing bulk density according to the present invention can be even more effectively carried out.

Subsequently, typical methods for producing granulated detergent particles containing an anionic surfactant as a main component of the surfactant, the granulated detergent particle being subjected to a treatment of increasing bulk density, are given below. Although the production methods are not particularly limited, the following methods may be, for instance, used to produce granulated detergent particles having a bulk density of from 500 to 1,000 g/liter.

(1) A method comprising the steps of preparing a spray-dried product containing an anionic surfactant by spray-drying, mixing or disintegrating-and-granulating the spray-dried product obtained above and a builder in a particular mixer (For instance, Japanese Patent Laid-Open No. 61-69897).

(2) A method comprising the steps of neutralizing in a dry state an acid precursor of an anionic surfactant with a solid alkali using a heavy duty shearing machine, and cooling and disintegrating the neutralized mixture (For instance, Japanese Patent Laid-Open No. 60-72999).

(3) A method comprising the steps of neutralizing in a dry state an acid precursor of an anionic surfactant with a solid alkali using a particular high-speed mixer (For instance, Japanese Patent Laid-Open Nos. 3-33199, 3-146599, and 5-86400).

(4) A method comprising the steps of neutralizing in a dry state an acid precursor of an anionic surfactant with a solid alkali and a hydrated inorganic builder using a particular mixer (For instance, Japanese Patent Unexamined Publication No. 6-502212).

(5) A method comprising the steps of neutralizing an acid precursor of an anionic surfactant with an aqueous alkali solution at a high concentration, kneading-and-mixing the above mixture with other detergent components, then disintegrating the mixture, and coating the product with fine powder (For instance, Japanese Patent Laid-Open No. 61-272300).

(6) A method for producing detergent granules, comprising the steps of contacting an anionic surfactant in the form of liquid or paste with a builder to form granules (For instance, Japanese Patent Laid-Open No. 2-29500, Japanese Patent Unexamined Publication No. 6-506720, and Japanese Patent Laid-Open No. 4-81500).

(7) A method for producing detergent granules, comprising the steps of homogeneously kneading an anionic surfactant and a builder to form a doughy mass, adding a builder thereto, and disintegrating-and-mixing the mixture to form granules (For instance, Japanese Patent Laid-Open No. 3-115400).

(8) A method comprising the steps of homogeneously kneading or pelletizing a mixture of an anionic surfactant and a builder to form a solid detergent, and disintegrating the solid detergent (For instance, Japanese Patent Laid-Open Nos. 61-76597 and 60-96698).

(9) A method comprising the steps of preparing a spray-dried powder containing an anionic surfactant and a nonionic surfactant by spray-drying, and continuously treating the above spray-dried powder using a particular high-speed mixer while adding a nonionic surfactant (Japanese Patent Laid-Open No. 1-311200).

By using the above methods, the granulated detergent particles containing an anionic surfactant as a main component of the surfactant and having a bulk density of 500 to 1,000 g/liter can be obtained. Particularly when the method according to item (1) is used, since spherical granulated detergent particles having a high bulk density can be obtained, the treatment of increasing bulk density according to the present invention can be even more effectively carried out.

3. Method for Treatment of Increasing Bulk Density

In the production method of the present invention, the granulated detergent particles prepared as mentioned above or the granulated detergent particles subjected to a conventional treatment of increasing bulk density are supplied to a rotary vessel mixer and mixed, while applying a shearing force, under given conditions, and the mixture is further subjected to a treatment of increasing bulk density. Next, the treatment of increasing bulk density using a drum mixer will be explained taking a drum mixer (horizontal cylinder mixer) as one example of a rotary vessel mixer, but the present invention is not intended to limit the method of the present invention thereto.

(1) Treatment of Increasing Bulk Density Using Drum Mixer

Figure 1B:
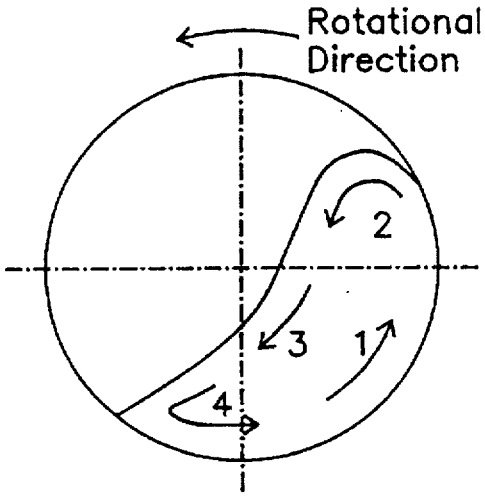

FIG. 1 shows a revolving state of the granulated detergent particles in a drum mixer. As the drum mixer filled with the granulated detergent particles revolves, Regions 1 to 4 as shown in FIG. 1 occur. 1 is an upward movement region, wherein the granulated detergent particles are forced to move upward by the centrifugal force due to rotation of the vessel and the friction caused by pressing the particles against an inner wall of the mixer owing to the dead weight of the granulated detergent particles. 2 is an upper inversion region wherein the upward movement of the granulated detergent particles are inverted at a point where a componential force of gravity acting inwardly toward the center of the vessel exceeds the centrifugal force. 3 is a cascading region wherein after inverting the direction, the granulated detergent particles are cascaded. 4 is a lower inversion region wherein the cascaded detergent particles are inverted at an impact point to thereby have a subsequent upward movement again.

As shown in FIG. 1, if there is any difference in speed between the upward movement region and the cascading region, a shearing force is generated by the speed difference and the dead weight of the granulated detergent particles. In the present invention, the term "mixing while applying a shearing force" is defined as mixing the granulated detergent particles, while applying a shearing force to particles caused by the mutual contact of the particles in the mixer. When the shearing force acts on the particles, the granulated detergent particles themselves are rotated, or the granulated detergent particles are mutually subjected to abrasion. By the above action, the granulated detergent particles are plastically deformed, thereby having improved sphericity (sphericity approaches 100%) and improved surface smoothness (surface smoothness factor becomes small). As a result, the detergent particles having a high bulk density can be obtained, wherein the bulk density of the granulated detergent particles having a bulk density of from 500 to 1,000 g/liter can be increased by 50 to 200 g/liter.

Particularly in the case of the granulated detergent particles containing a nonionic surfactant as a main component of the surfactant, the amount of fine powder is lowered by the treatment of increasing bulk density using a rotary vessel mixer. In other words, the fine powders originally owned by the granulated detergent particles and the fine powders produced by the mutual abrasion of the granulated detergent particles are presumably incorporated to the surface of the granulated detergent particles by an appropriate adhesive force of the nonionic surfactant existing on the surface of the granulated detergent particles upon the treatment of increasing bulk density.

Examples of the drum mixers suitably used for the treatment of increasing bulk density used in the present invention are not particularly limited as long as the treatment can be carried out by rotating the drum-shaped cylinder. In addition to the drum mixers (horizontal cylinder mixers) mentioned above, examples of modified drum mixers include conical drum granulators (mixers), multi-stepped conical drum granulators (mixers), drum granulators (mixers) equipped with inclined recycle plates, drum granulators (mixers) equipped with classifying wear segments, double cylindrical granulators (mixers), and drum granulators (mixers) equipped with paddle agitators, all of which are disclosed in Zoryu Binran, published by The Association of Powder Process Industry and Engineering, Japan, First Edition, Second Printing. Besides them, examples of mixers similar to the drum mixers include ROTARY MIXER (manufactured by Meiwa Kogyo Co., Ltd.), and DRUM MIXER (manufactured by Sugiyama Heavy Industrial Co., Ltd.). Also, PAN film coating apparatus such as DORIA COATER (manufactured by Powrex Corporation) and AQUA COATER (manufactured by Freund Industrial Co., Ltd.), KURIMOTO INDIRECT ROTARY PYRO-PROCESSING UNIT (manufactured by Kurimoto Ltd.), and ROTARY DRIER WITH DISINTEGRATOR (manufactured by Okawara Manufacturing Co., Ltd.) are usable for the treatment of increasing bulk density.

Since the drum mixers are mixers causing mixing while applying a large shearing force, and having a simple shape and being easily continuously operable, they are suitable for large-scale production, making it most suitable for the treatment of increasing the bulk density. Incidentally, in these mixers, since a strong shearing force between the vessel and granulated detergent particles are not generated, no adhesion of the granulated detergent particles to the vessel or no breaking of the granulated detergent particles substantially takes place. In addition, the mixers can process a large amount of particles relative to volume of an apparatus.

When a coefficient of friction of the wall surface between the granulated detergent particles and the inner wall of a rotary vessel mixer is small, so that it is difficult to give a sufficient upward movement force to the granulated detergent particles, a plural number of baffles are attached to the inner wall of the vessel in order to forcibly produce an upward movement. The height of the baffles is preferably equal to or less than 0.25 times the rotation radius of the rotary vessel mixer from the viewpoint of not inhibiting the particles from cascading along the slant of the particle layer.

(2) Production Conditions of Detergent Particles Having High Bulk Density

In the present invention, suitable conditions for the treatment of increasing the bulk density using the rotary vessel mixer are the following (i) to (iii).

(i) Treatment time

In the method for producing the detergent particles having a high bulk density of the present invention, the treatment time for increasing bulk density in a batch process or the mean residence time defined by the equation given below in a continuous process is generally in the range of from 5 to 120 minutes, preferably in the range of from 10 to 90 minutes, and particularly preferably in the range of from 10 to 40 minutes. From the viewpoint of sufficiently increasing the bulk density of the treated detergent particles, the treatment time or the mean residence time is preferably not less than 5 minutes. From the viewpoint of preventing decrease in productivity and breaking of the granulated detergent particles, the treatment time or the mean residence time is preferably not more than 120 minutes.

$$Tm=(m/Q)\times 60$$

Here, Tm stands for a mean residence time [minutes]; m stands for an amount of detergent granules resided in the rotary vessel mixer [kg]; and Q stands for a treatment capacity in a continuous operation [kg/hr].

(ii) Froude number=Fr

In the method for producing detergent particles having a high bulk density according to the present invention, conditions are selected to have a Froude number defined by the equation given below satisfy in the range of from 0.2 to 0.7, more preferably from 0.2 to 0.55, and further preferably from 0.25 to 0.5. From the viewpoint of carrying out a treatment of increasing bulk density in a short period of time, the Froude number is preferably not less than 0.2. When using a drum mixer, for instance, from the viewpoint of normal achievement of a mixing while applying a shearing force, wherein the granulated detergent particles are capable of being inverted in the upper inversion region (2 in FIG. 1) without being scattered, the Froude number is preferably not more than 0.7.

$$Fr=V^2/(R\times g).$$

Here, V stands for a peripheral speed of the outermost circumference of a rotary vessel mixer (m/s); R stands for a radius from a center of rotation of the outermost circumference of the rotary vessel mixer [m]; and g stands for a gravitational acceleration [$m/s^2$].

(iii)Volume Packing Fraction=x[%]

In the method for producing detergent particles having a high bulk density according to the present invention, conditions are selected to have a volume packing fraction defined by the equation given below satisfy the range of from 15 to 50%, preferably from 20 to 45%, and more preferably from 25 to 40%. From the viewpoint of productivity, the volume packing fraction is preferably not less than 15%. From the viewpoint of good achievement of a mixing while applying a shearing force, the volume packing fraction is preferably not more than 50%.

$$x=(M/\rho)/V\times 100.$$

Here, M stands for an amount of the granulated detergent particles charged to the rotary vessel mixer [g]; ρ stands for a bulk density of the granulated detergent particles [g/liter]; and V stand for a volume of the rotary vessel mixer [liters].

The detergent particles having a high bulk density can be produced in a batch process or a continuous process. In order to continuously produce detergent particles having a high bulk density, mixers having a mixing state close to that of the plug flow (extrusion flow) are preferred. Starting materials are continuously supplied from one end (a flat plate portion at the side wall of the rotary vessel mixer), transported in flow to the other side, and discharged from the other side (a flat plate portion at the side wall of the rotary vessel mixer, the flat plate portion being arranged opposite to the supply side). Also, the rotary vessel mixer may be inclined in a descending direction from the supply side to the discharge side, so that the discharge of the obtained granulated detergent particles can be made easy. The angle of inclination is preferably from 0° to 20°, more preferably from 0° to 5°. From the viewpoint of inhibiting the efficiency of increasing bulk density from lowering due to contamination with granulated detergent particles not subjected to a treatment of increasing bulk density, the angle of inclination is preferably not more than 20°.

In the case of a continuous process, in order to further enhance the mixing state close to that of the plug flow in the rotary vessel mixer, a plural number of partition plates arranged perpendicular to a center line of rotation in the vessel are attached at several locations in the direction of the center line of rotation, so that tumbling of the particles towards the discharge direction can be inhibited when the particles are cascaded along the slant of the particle layer.

Also, by having-agitation impellers arranged on a central shaft parallel to a center line of rotation of the rotary vessel mixer, the time for the treatment of increasing bulk density can be shortened. By the application of stirring to the part of the granulated detergent particles cascade along the slant of the particle layer, a shearing force and an impact force are applied to the granulated detergent particles, so that the sphericity and the surface smoothness are improved within a short period of time, thereby shortening the time for the treatment of increasing bulk density. The agitation impellers may be rotated in the same direction as or the opposite direction to the rotations of the rotary vessel mixer. A preference is given to applying stirring in the direction opposite to the cascading movement of the granulated particles (rotating in the same direction as the rotations of the vessel), because the relative speed of the agitation impellers to the granulated detergent particles is increased, thereby remarkably increasing the effects of using the agitation impellers.

The rotation radius of the agitation impellers is not more than 0.8 times the rotation radius of the rotary vessel mixer, preferably not more than 0.7 times. When the space between the inner wall of the rotary vessel mixer and the agitation impellers is small, a strong shearing force is applied to the granulated detergent particles, which results in breaking the granulated detergent particles and thereby interfering with the increase in bulk density. From the viewpoint of preventing such drawbacks, the rotation radius of the agitation impellers is preferably equal to or less than 0.8 times the rotation radius of the rotary vessel mixer.

The tip end speed of the agitation impellers is from 1 to 6 m/s, preferably from 2.5 to 5 m/s. From the viewpoint of applying a sufficient stirring force to the granulated detergent particles, the tip end speed is preferably not less than 1 m/s. From the viewpoint of preventing interference with the increase in bulk density due to breaking of the granulated detergent particles, the tip end speed is preferably not more than 6 m/s.

The shape of the agitation impellers in a continuous process is preferably those which do not interfere with a mixing state close to that of the plug flow of the rotary vessel mixer. Examples thereof include rod-shaped or plate-like impellers arranged parallel to the center line of rotation of the rotary vessel mixer. When the mixing state close to that of the plug flow is interfered, the width of the residence time distribution of the obtained product is made large, so that the granulated detergent particles not subjected to a treatment of increasing bulk density are mixed in the granulated detergent particles subjected to a treatment of increasing bulk density. This may consequentially make it difficult to increase bulk density by 50 to 200 g/liter in certain cases. In addition, in the continuous process, by adjusting the number of agitation impellers arranged in the direction of circulation of the granulated detergent particles in the rotary vessel mixer, the extent of increasing a bulk density can be controlled.

Also, in the present invention, the fine powder may be added upon the treatment of increasing the bulk density to prevent re-granulation and aggregation. Many nonionic surfactants are completely or partly liquefied at room temperature (10° to 30° C.). Therefore, when such liquefied nonionic surfactants are present on the surface of the granulated detergent particles, a slight adhesion force is given to the surface of the granulated detergent particles. Therefore, mixing such particles in the rotary vessel mixer may cause re-granulation and aggregation of the granulated detergent particles, so that a sufficient increase in bulk density is often inhibited. Many anionic surfactants, on the other hand, are pasty at room temperature (10° to 30° C.) and have tackiness. Therefore, for the similar reasons given above for the case of the nonionic surfactants, when such anionic surfactants having tackiness are present on the surface of the granulated detergent particles, re-granulation and aggregation of the granulated detergent particles are caused, so that a sufficient increase in bulk density is often inhibited. In particular, it is preferable to add the fine powder to the granulated detergent particles containing an anionic surfactant as a main component of the surfactant in the process of heating and mixing while applying a shearing force.

In order to prevent the above phenomenon, the fine powder whose primary particles have an average primary particle size of not more than 10 μm is added in an amount of usually from 0.1 to 10.0 parts by weight, preferably from 0.2 to 5.0 parts by weight, based on 100 parts by weight of the granulated detergent particles. By adding the fine powder, the tackiness of the surface of the granulated detergent particles is lowered, so that the treatment of increasing bulk density is well progressed. Incidentally, the amount of the fine powder is preferably not less than 0.1 parts by weight, based on 100 parts by weight of the granulated detergent particles. From the viewpoint of preventing the worsening of the flowability of the granulated detergent particles by containing excessive fine powder and lowering of the efficiency of the treatment of increasing bulk density, the amount of the fine powder is preferably not more than 10.0 parts by weight.

Here, the average particle size of the primary particles is measured according to a method utilizing the light scattering, for example, using LASER SCATTERING PARTICLE SIZE DISTRIBUTION ANALYZER (manufactured by HORIBA Ltd.) or measured by making a microscopic observation.

The above powders may be any known powders generally used, without being particularly limited. A preference is given to compounds having an average primary particle size of not more than 10 μm, including crystalline or amorphous aluminosilicates and silicate compounds, such as silicon dioxide, bentonite, talc, clay, calcium silicate, calcium carbonate, magnesium carbonate, perlite, and amorphous silica derivatives. In particular, crystalline aluminosilicates are preferred, and specific examples thereof include ZEOLITE 4A (TOYOBUILDER, manufactured by Tosoh Corporation, powdery product).

(3) Shape of Granulated Detergent Particles Having High Bulk Density

In the present invention, the degree of sphericity, the surface smoothness factor, and the ratio of increasing bulk density are defined as follows.

(i) Degree of Sphericity=ψ [%]

Measurement is taken on a two-dimensional projected image of the granulated detergent particles and the degree of sphericity is defined by the equation given below.

$$\psi=(ML^2\times\pi)/(4\times A)\times 100$$

Figure 2:
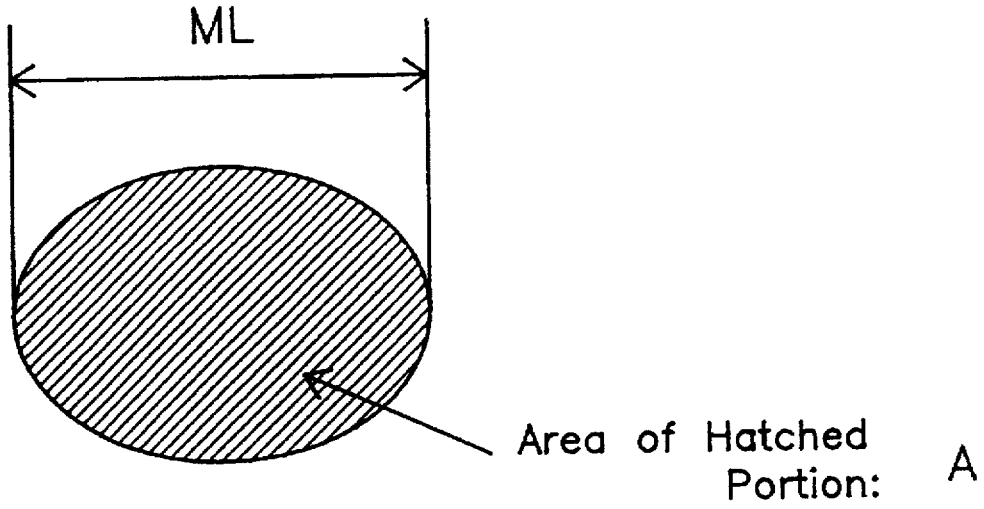
FIG. 2 is a view showing the relationship between ML (maximum length of the granulated detergent particles) and A (projected image area of the granulated detergent particles) in a two-dimensional projected image of the granulated detergent particles.

Here, ML stands for a maximum length of the granulated detergent particles [μm]; π stands for a ratio of the circumference of a circle to its diameter; and A stands for an area of a projected image of the granulated detergent particles [$\mu m^2$]. FIG. 2 shows the relationship between ML and A. ψ [%] is a mean value of values obtained by measuring 300 granulated detergent particles. Here, as the projected shape of the particles is closer to a circle (having increased sphericity), ψ (degree of sphericity) becomes closer to 100.

(ii) Surface Smoothness Factor=Rz [μm]

Figure 3B:
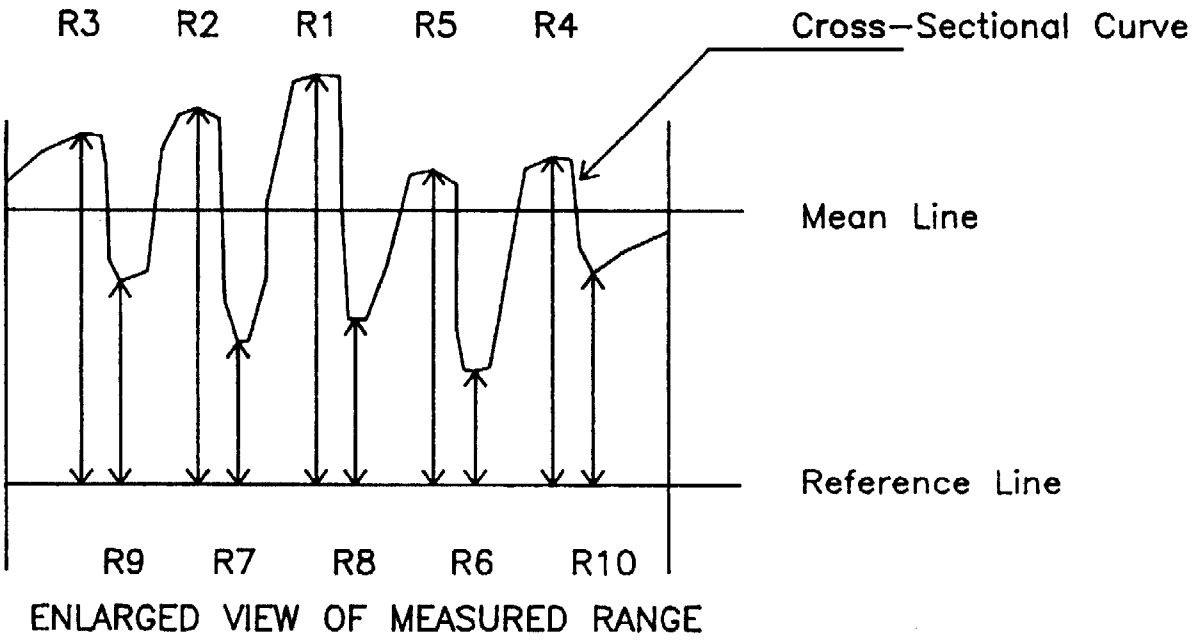
FIG. 3 is a schematic view showing the relationships of cross-sectional curve, a reference line, etc. used for measuring a surface smoothness factor of the granulated detergent particles using a three-dimensional, scanning electron microscope.
Figure 3A:
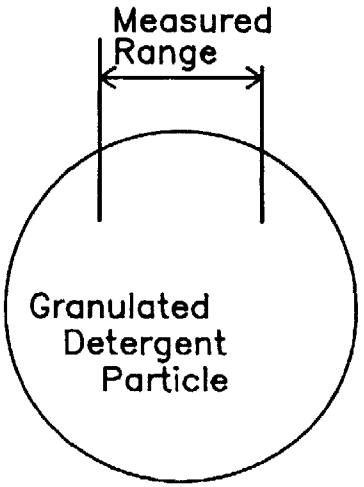

A ruggedness of the surface of the granulated detergent particles is measured by scanning a given region of the surface with a three-dimensional scanning electron microscope (electron beam surface condition analyzer, ESA-3000, manufactured by ELIONIX INC.). The surface smoothness factor is defined by the equation given below, based on the difference, expressed in μm, between a mean height of the highest through the fifth-highest peaks measured from a given line (reference line) and a mean height of the lowest through the fifth-lowest valleys measured from the reference line, the reference line being a line parallel to a mean line and not intersecting with a cross-sectional curve obtained by the scanning. FIG. 3 is a schematic view showing the cross-sectional curve and the reference line, etc.

$$Rz=\frac{((R1+R2+R3+R4+R5)-(R6+R7+R8+R9+R10))}{5}$$

Here, R1 to R5 stand for heights of the highest through the fifth-highest peaks, and R6 to R10 stand for heights of the lowest through the fifth-lowest valleys. Rz is a mean value obtained by repeating 100-time scanning measurements of the surface for each particle in an analyzing range of 60 μm, and similarly measuring for 10 particles. Incidentally, in R1 through R10, fluctuations in heights ascribed to the curvature of particles are eliminated by a filter process and the heights based only on the ruggedness of the surface are utilized. More the surface smoothness is improved, smaller the Rz becomes.

According to the method for producing the detergent particles having a high bulk density of the present invention, the detergent particles after the treatment of increasing bulk density have a surface smoothness factor of not more than 70% of the surface smoothness factor for the starting material granulated detergent particles as set forth below in Examples.

(iii) Ratio of Increasing Bulk Density=α [%]

The ratio of increasing bulk density is an index showing the extent of increase in bulk density of the detergent particles, which is defined by the equation given below.

$$\alpha=\frac{\left[\begin{array}{c}\text{(Bulk Density}\\ \text{after Treatment)}\end{array}-\begin{array}{c}\text{(Bulk Density}\\ \text{before Treatment)}\end{array}\right]}{\text{(Bulk Density before Treatment)}}\times 100$$

The detergent particles with a greater increase in bulk density have a greater α value.

The present invention will be explained in detail by means of Examples and Comparative Examples, without intending to limit the scope of the present invention to these Examples.

EXAMPLE 1

First, granulated detergent particles having a nonionic surfactant as a main component of the surfactants were prepared as follows. An amorphous aluminosilicate (8.7 kg) was supplied into a Lödige mixer (manufactured by Matsusaka Giken Kabushiki Kaisha; capacity: 130 liters; clearance from agitation impellers to inner. wall: about 5 mm), and stirring was initiated with the mixer having a main axis (100 rpm) and a chopper (3,000 rpm). Polyoxyethylene dodecyl ether (average molar number of ethylene oxide adducts=8; melting point: 15° C.; HLB 10.14) (15.3 kg) was supplied as a nonionic surfactant to the above mixture in 2 minutes, and stirring was stopped after 4 minutes. Next, ZEOLITE 4A (6.0 kg) was supplied, and the mixture was stirred for 30 seconds. After taking the mixture out of the mixer, coarse grains were eliminated using a sieve with a 1410-μm-opening. Here, the entire charged amount was 30 kg. The granulated detergent particles having a nonionic surfactant as a main component of the surfactant obtained by the above method were supplied into a drum mixer in an amount of 15.3 kg at a volume packing fraction of 30%, the drum mixer having a cylindrical diameter of 400 mm, a cylindrical length of 600 mm, and a volume of 75.4 liters. The powder temperature at supplying was 25° C. In the following Examples, etc., unless otherwise specified, the powder temperature at supplying was 25° C. Here, the bulk density of the granulated detergent particles was 675 g/liter. The granulated detergent particles were subjected to a treatment of increasing bulk density using a drum mixer with a Froude number of 0.3 and a rotational speed of 37 rpm for 60 minutes, to give detergent particles having a high bulk density with a bulk density of 730 g/liter.

Figure 4:
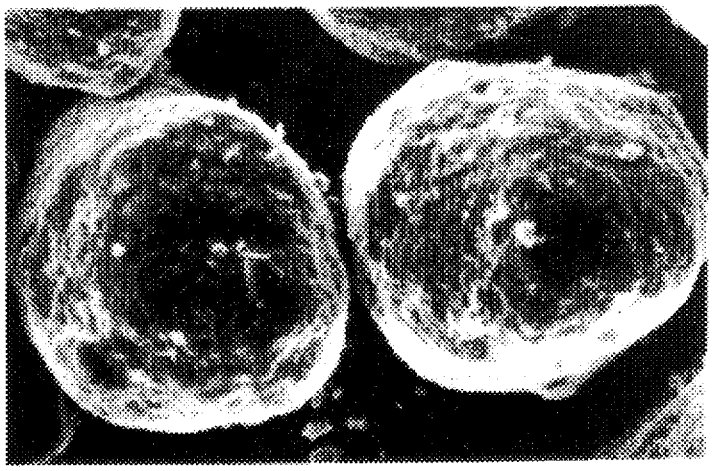
FIG. 4 is a photograph showing a particle structure obtained by microscopic observation of the granulated detergent particles before a treatment of increasing bulk density in Example 1.
Figure 5:
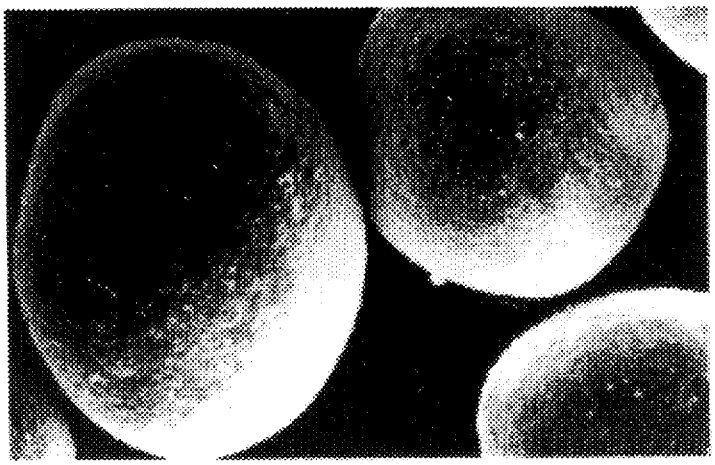
FIG. 5 is a photograph showing a particle structure obtained by microscopic observation of the granulated detergent particles after a 60-minute treatment of increasing bulk density in Example 1.

A photomicrograph of the granulated detergent particles before the treatment of increasing bulk density is shown in FIG. 4, and a photomicrograph of the granulated detergent particles after the 60-minute treatment of increasing bulk density is shown in FIG. 5. Also, the composition of the granulated detergents, the conditions of the drum mixer, and the changes of the powder properties of the detergent particles having a high bulk density over the treatment time are shown in Table 1 and Table 2. As is clear from FIGS. 4 and 5, it was found that substantially no changes in the average particle size took place, and substantially no granulated detergent particles were destroyed. The amount of fine powder (the particles passing through a sieve with 125-μm-opening being expressed in % by weight) was lowered, presumably meaning that the fine powders were incorporated into the surface of the granulated detergent particles. Further, it was confirmed that the detergent particles were formed into spherical shapes. In addition, the surface smoothness factor became small, confirming that the surface of the detergent particles was smoothened. Also, substantially no adhesion of the detergent particles to the inside of the drum mixer took place, so that almost the entire amount, based on the charged amount, were recovered.

Here, the bulk density of the granulated detergent particles was measured 5 hours after terminating the experiment, according to a method of JIS K 3362. Also, the fluidity was evaluated by measuring a time period required for 100 ml of the granulated detergent particles to flow out from a hopper as defined by JIS K 3362, wherein the shorter the time period, the better the fluidity. The average particle size was measured by vibrating the granulated detergent particles for 5 minutes using standard sieves according to JIS Z 8801 to calculate a weight percentage depending upon the size opening of the sieves. Also, the ratio of increasing bulk density in the batch process was calculated by setting the bulk density of the detergent particles after a 60-minute treatment of increasing bulk density as an after-treatment bulk density.

EXAMPLE 2

First, granulated detergent particles having a nonionic surfactant as a main component of the surfactant were prepared as follows. Sodium carbonate (10.5 kg) and an amorphous aluminosilicate (5.1 kg) were supplied into a L ödige mixer (manufactured by Matsusaka Giken Kabushiki Kaisha; capacity: 130 liters; clearance from agitation impellers to inner wall: about 5 mm), and stirring was initiated with the mixer having a main axis (100 rpm) and a chopper (3,000 rpm). Polyoxyethylene dodecyl ether (average molar number of ethylene oxide adducts=8; melting point: 15° C.; HLB 10.14) (9.0 kg) was supplied to as a nonionic surfactant the above mixture in 2 minutes, and stirring was stopped after 5 minutes. Next, ZEOLITE 4A (5.4 kg) was supplied, and the mixture was stirred for 30 seconds. After taking the mixture out of the mixer, coarse grains were eliminated using a sieve with a 1410-μm-opening. Here, the entire charged amount was 30 kg. The granulated detergent particles having a nonionic surfactant as a main component of the surfactant obtained by the above method were supplied into a drum mixer in an amount of 18.1 kg at a volume packing fraction of 30%, the drum mixer having a cylindrical diameter of 400 mm, a cylindrical length of 600 mm, and a volume of 75.4 liters. Here, the bulk density of the granulated detergent particles was 800 g/liter. The granulated detergent particles were subjected to a treatment of increasing bulk density using a drum mixer with a Froude number of 0.3 and a rotational speed of 37 rpm for 60 minutes, to give detergent particles having a high bulk density with a bulk density of 888 g/liter. The composition of the granulated detergents, the conditions of the drum mixer, and the changes of the powder properties of the detergent particles having a high bulk density over the treatment time are shown in Table 1 and Table 2.

EXAMPLE 3

First, granulated detergent particles having a nonionic surfactant as a main component of the surfactant were prepared as follows. Sodium carbonate (19.0 kg) and an amorphous aluminosilicate (2.6 kg) were supplied into a L ödige mixer (manufactured by Matsusaka Giken Kabushiki Kaisha; capacity: 130 liters; clearance from agitation impellers to inner wall: about 5 mm), and stirring was initiated with the mixer having a main axis (100 rpm) and a chopper (3,000 rpm). Polyoxyethylene dodecyl ether (average molar number of ethylene oxide adducts=8; melting point: 15° C.; HLB 10.14) (4.5 kg) was supplied as a nonionic surfactant to the above mixture in one minute, and stirring was stopped after 8 minutes. Next, ZEOLITE 4A (3.9 kg) was supplied, and the mixture was stirred for 30 seconds. After taking the mixture out of the mixer, coarse grains were eliminated using a sieve with a 1410-μm-opening. Here, the entire charged amount was 30 kg. The granulated detergent particles having a nonionic surfactant as a main component of the surfactant obtained by the above method were supplied into a drum mixer in an amount of 20.5 kg at a volume packing fraction of 30%, the drum mixer having a cylindrical diameter of 400 mm, a cylindrical length of 600 mm, and a volume of 75.4 liters. Also, ZEOLITE 4A (average particle size: 3 μm) (0.2 kg) was simultaneously supplied as fine particles. Here, the bulk density of the granulated detergent particles was 905 g/liter. The granulated detergent particles were subjected to a treatment of increasing bulk density using a drum mixer with a Froude number of 0.3 and a rotational speed of 37 rpm for 60 minutes, to give detergent particles having a high bulk density with a bulk density of 1015 g/liter. The composition of the granulated detergents, the conditions of the drum mixer, and the changes of the powder properties of the detergent particles having a high bulk density over the treatment time are shown in Table 1 and Table 2.

EXAMPLE 4

The granulated detergent particles having a nonionic surfactant as a main component of the surfactant produced in Example 2 were used. The granulated detergent particles were supplied into a drum mixer in an amount of 18.1 kg at a volume packing fraction of 30%, the drum mixer having a cylindrical diameter of 400 mm, a cylindrical length of 600 mm, and a volume of 75.4 liters. Here, the bulk density of the granulated detergent particles was 800 g/liter. The granulated detergent particles were subjected to a treatment of increasing bulk density using a drum mixer with a Froude number of 0.2 and a rotational speed of 30 rpm for 60 minutes, to give detergent particles having a high bulk density with a bulk density of 883 g/liter. The composition of the granulated detergents, the conditions of the drum mixer, and the changes of the powder properties of the detergent particles having a high bulk density over the treatment time are shown in Table 1 and Table 2.

EXAMPLE 5

The granulated detergent particles having a nonionic surfactant as a main component of the surfactant produced in Example 2 were used. The granulated detergent particles were supplied into a drum mixer in an amount of 18.1 kg at a volume packing fraction of 30%, the drum mixer having a cylindrical diameter of 400 mm, a cylindrical length of 600 mm, and a volume of 75.4 liters. Here, the bulk density of the granulated detergent particles was 800 g/liter. The granulated detergent particles were subjected to a treatment of increasing bulk density using a drum mixer with a Froude number of 0.5 and a rotational speed of 47 rpm for 60 minutes, to give detergent particles having a high bulk density with a bulk density of 891 g/liter. The composition of the granulated detergents, the conditions of the drum mixer, and the changes of the powder properties of the detergent particles having a high bulk density over the treatment time are shown in Table 1 and Table 2.

EXAMPLE 6

The granulated detergent particles having a nonionic surfactant as a main component of the surfactant produced in Example 2 were used. The granulated detergent particles were supplied into a drum mixer in an amount of 18.1 kg. at a volume packing fraction of 30%, the drum mixer having a cylindrical diameter of 400 mm, a cylindrical length of 600 mm, and a volume of 75.4 liters. Here, the bulk density of the granulated detergent particles was 800 g/liter. The drum mixer was operated at a Froude number of 0.3 and a rotational speed of 37 rpm. At the same time, agitation impellers each having a shaft parallel to the center line of rotation of the drum mixer with a radius of 120 mm (0.6 times the distance to the innermost circumference of the drum mixer) was operated by stirring in a reverse direction of the cascading of the granulated detergent particles along the slant of the particle layer (in the same rotational direction as that of the drum mixer), the agitation impellers having a rotational speed of 80 rpm and a tip end speed of 1.0 m/s. The drum mixer was operated for 40 minutes, to give detergent particles having a high bulk density with a bulk density of 888 g/liter. The composition of the granulated detergents, the conditions of the drum mixer, and the changes of the powder properties of the detergent particles having a high bulk density over the treatment time are shown in Table 3 and Table 4. When compared with Example 2, it was confirmed that the agitation impellers effectively served to shorten the time required for the treatment of increasing bulk density.

EXAMPLE 7

The granulated detergent particles having a nonionic surfactant as a main component of the surfactant produced in Example 2 were used. The granulated detergent particles were supplied into a drum mixer in an amount of 18.1 kg at a volume packing fraction of 30%, the drum mixer having a cylindrical diameter of 400 mm, a cylindrical length of 600 mm, and a volume of 75.4 liters. Here, the bulk density of the granulated detergent particles was 800 g/liter. The drum mixer was operated at a Froude number of 0.3 and a rotational speed of 37 rpm. At the same time, agitation impellers each having shaft parallel to the center line of rotation of the drum mixer with a radius of 120 mm (0.6 times the distance to the innermost circumference of the drum mixer) was operated by stirring in a reverse direction of the cascading of the granulated detergent particles along the slant of the particle layer (in the same rotational direction as that of the drum mixer), the agitation impellers having a rotational speed of 240 rpm and a tip end speed of 3.0 m/s. The drum mixer was operated for 30 minutes, to give detergent particles having a high bulk density with a bulk density of 888 g/liter. The composition of the granulated detergents, the conditions of the drum mixer, and the changes of the powder properties of the detergent particles having a high bulk density over the treatment time are shown in Table 3 and Table 4. When compared with Example 2, it was confirmed that the agitation impellers effectively served to shorten the time required for the treatment of increasing bulk density.

EXAMPLE 8

The granulated detergent particles having a nonionic surfactant as a main component of the surfactant produced in Example 2 were used. The granulated detergent particles were supplied into a drum mixer in an amount of 18.1 kg at a volume packing fraction of 30%, the drum mixer having a cylindrical diameter of 400 mm, a cylindrical length of 600 mm, and a volume of 75.4 liters. At the same time, ZEOLITE 4A (0.2 kg) was supplied as fine particles. Also, 4 baffles with a height of 30 mm (0.15 times the rotation radius) were attached to the drum mixer over its full length. Here, the bulk density of the granulated detergent particles was 800 g/liter. The drum mixer was operated at a Froude number of 0.3 and a rotational speed of 37 rpm. At the same time, an agitation impellers each having a shaft parallel to the center line of rotation of the drum mixer with a radius of 120 mm (0.6 times the distance to the innermost circumference of the drum mixer) was operated by stirring in a reverse direction of the cascading of the granulated detergent particles along the slant of the particle layer (in the same rotational direction as that of the drum mixer), the agitation impellers having a rotational speed of 240 rpm and a tip end speed of 3.0 m/s. The drum mixer was operated for 20 minutes, to give detergent particles having a high bulk density with a bulk density of 882 g/liter. The composition of the granulated detergents, the conditions of the drum mixer, and the changes of the powder properties of the detergent particles having a high bulk density over the treatment time are shown in Table 3 and Table 4. When compared with Example 2, it was confirmed that the agitation impellers effectively served to shorten the time required for the treatment of increasing bulk density. When compared with Example 7, it was also confirmed that attachment of the baffles further reduced the time required for the treatment of increasing bulk density.

EXAMPLE 9

The granulated detergent particles having a nonionic surfactant as a main component of the surfactant produced in Example 2 were used. The granulated detergent particles were continuously supplied into a drum mixer (continuous type) having a cylindrical diameter of 600 mm, a cylindrical length of 1200 mm, and a volume of 339 liters. The size of the outlet of the drum mixer was adjusted in advance to thereby have a volume packing fraction of 30%. The drum mixer was used without giving a tilt at the outlet side. The drum mixer was operated at a Froude number of 0.3 and a rotational speed of 30 rpm. At the same time, agitation impellers each having a shaft parallel to the center line of rotation of the drum mixer with a radius of 155 mm (0.52 times the distance to the innermost circumference of the drum mixer) was operated by stirring in a reverse direction of the cascading of the granulated detergent particles along the slant of the particle layer (in the same rotational direction as that of the drum mixer), the agitation impellers having a rotational speed of 153 rpm and a tip end speed of 2.5 m/s. Here, the bulk density of the granulated detergent particles was 800 g/liter.

When the granulated detergent particles were continuously supplied at 500 kg/hr, detergent particles having a high bulk density with a bulk density of 850 g/liter were obtained. It was found by measuring the amount of the granulated detergent particles residing in the drum mixer that the mean residence time of the granulated detergent particles in the drum mixer was about 10 minutes.

When the granulated detergent particles were continuously supplied at 250 kg/hr, detergent particles having a high bulk density with a bulk density of 873 g/liter were obtained. It was found by measuring the amount of the granulated detergent particles residing in the drum mixer that the mean residence time of the granulated detergent particles in the drum mixer was about 20 minutes.

When the granulated detergent particles were continuously supplied at 166 kg/hr, detergent particles having a high bulk density with a bulk density of 887 g/liter were obtained. It was found by measuring the amount of the granulated detergent particles residing in the drum mixer that the mean residence time of the granulated detergent particles in the drum mixer was about 30 minutes.

The composition of the granulated detergents, the conditions of the drum mixer, and the changes of the powder properties of the detergent particles having a high bulk density with respect to the mean residence time are shown in Table 3 and Table 4.

EXAMPLE 10

The granulated detergent particles having a nonionic surfactant as a main component of the surfactant produced in Example 2 were used. The granulated detergent particles were continuously supplied into a drum mixer (continuous type) having a cylindrical diameter of 600 mm, a cylindrical length of 1200 mm, and a volume of 339 liters. The size of the outlet of the drum mixer was adjusted in advance, to thereby have a volume packing fraction of 30%. The drum mixer was tilted with an angle of 3° to lower the outlet side. The drum mixer was operated at a Froude number of 0.3 and a rotational speed of 30 rpm. At the same time, agitation impellers each having a shaft parallel to the center line of rotation of the drum mixer with a radius of 155 mm (0.52 times the distance to the innermost circumference of the drum mixer) was operated by stirring in a reverse direction of the cascading of the granulated detergent particles along the slant of the particle layer (in the same rotational direction as that of the drum mixer), the agitation impellers having a rotational speed of 153 rpm and a tip end speed of 2.5 m/s. Also, 4 disc-shaped partition plates, each partition plate with a diameter of 350 mm were attached to the center line of rotation of the drum at an interval of 240 mm, the partition plate being placed at a right angle to the center line of rotation of the drum. Here, the bulk density of the granulated detergent particles was 800 g/liter.

When the granulated detergent particles were continuously supplied at 500 kg/hr, detergent particles having a high bulk density with a bulk density of 852 g/liter were obtained. It was found by measuring the amount of the granulated detergent particles residing in the drum mixer that the mean residence time of the granulated detergent particles in the drum mixer was about 10 minutes.

When the granulated detergent particles were continuously supplied at 250 kg/hr, detergent particles having a high bulk density with a bulk density of 876 g/liter were obtained. It was found by measuring the amount of the granulated detergent particles residing in the drum mixer that the mean residence time of the granulated detergent particles in the drum mixer was about 20 minutes.

When the granulated detergent particles were continuously supplied at 166 kg/hr, detergent particles having a high bulk density with a bulk density of 889 g/liter were obtained. It was found by measuring the amount of the granulated detergent particles residing in the drum mixer that the mean residence time of the granulated detergent particles in the drum mixer was about 30 minutes.

The composition of the granulated detergents, the conditions of the drum mixer, and the changes of the powder properties of the detergent particles having a high bulk density with respect to the mean residence time are shown in Table 3 and Table 4.

EXAMPLE 11

First, granulated detergent particles having a nonionic surfactant as a main component of the surfactant were prepared as follows. Sodium carbonate (11.4 kg) and an amorphous aluminosilicate (5.1 kg) were supplied into a Lödige mixer (manufactured by Matsusaka Giken Kabushiki Kaisha; capacity: 130 liters; clearance from agitation impellers to inner wall: about 5 mm), and stirring was initiated with the mixer having a main axis (100 rpm) and a chopper (3,000 rpm). Polyoxyethylene dodecyl ether (average molar number of ethylene oxide adducts=8; melting point: 15° C.; HLB 10.14) (9.0 kg) was supplied as a nonionic surfactant to the above mixture in one minute, and stirring was stopped after 3 minutes. Next, ZEOLITE 4A (4.5 kg) was supplied, and the mixture was stirred for 30 seconds. After taking the mixture out of the mixer, coarse grains were eliminated using a sieve with a 1410-μm-opening. Here, the entire charged amount was 30 kg.

The granulated detergent particles having a nonionic surfactant as a main component of the surfactant obtained by the above method were supplied into a drum mixer in an amount of 18.7 kg at a volume packing fraction of 30%, the drum mixer having a cylindrical diameter of 400 mm, a cylindrical length of 600 mm, and a volume of 75.4 liters. Here, the bulk density of the granulated detergent particles was 828 g/liter. The granulated detergent particles were subjected to a treatment of increasing bulk density using a drum mixer with a Froude number of 0.3 and a rotational speed of 37 rpm for 60 minutes, to give detergent particles having a high bulk density with a bulk density of 828 g/liter. Around 40 minute after the start of the treatment of increasing bulk density, the granulated detergent particles were slightly aggregated, thereby showing an almost constant bulk density. Therefore, ZEOLITE 4A (0.4 kg) with an average particle size of 3 μm was mixed with the granulated detergent particles (18.7 kg). In this case, the bulk density of the granulated detergent particles was increased without causing aggregation. After the granulated detergent particles were subjected to a 60-minute treatment of increasing bulk density, detergent particles having a high bulk density with a bulk density of 890 g/liter were obtained. The composition of the granulated detergents, the conditions of the drum mixer, and the changes of the powder properties of the detergent particles having a high bulk density over the treatment time are shown in Table 5 and Table 6.

EXAMPLE 12

First, granulated detergent particles having a nonionic surfactant as a main component of the surfactant were prepared as follows. Polyoxyethylene dodecyl ether (average molar number of ethylene oxide adducts=8; melting point: 15° C.; HLB 10.14) (6.9 kg) as a nonionic surfactant was heated and mixed with a fatty acid (palmitic acid) (1.4 kg) at a temperature of 70° C. to prepare a mixed solution. Next, sodium carbonate (11.1 kg), ZEOLITE 4A (2.8 kg), and an amorphous aluminosilicate (5.6 kg) were supplied into a Lödige mixer (manufactured by Matsusaka Giken Kabushiki Kaisha; capacity: 130 liters; clearance from agitation impellers to inner wall: about 5.0 mm; equipped with a jacket), and stirring was initiated with the mixer having a main axis (100 rpm) and a chopper (3,000 rpm). Hot water at 75° C. was circulated in the jacket at 20 liters/minute. The mixed solution prepared above was supplied to the above mixer in 4 minutes and then stirred for 6 minutes. Subsequently, ZEOLITE 4A (2.2 kg) was supplied, and the mixture was stirred for 1.5 minutes to modify the surface of the particles. After taking the mixture out of the mixer, coarse grains were eliminated using a sieve with a 1410-μm-opening. Here, the entire charged amount was 30 kg. The granulated detergent particles having a nonionic surfactant as a main component of the surfactant obtained by the above method were supplied into a drum mixer in an amount of 18.8 kg at a volume packing fraction of 30%, the drum mixer having a cylindrical diameter of 400 mm, a cylindrical length of 600 mm, and a volume of 75.4 liters. Here, the bulk density of the granulated detergent particles was 830 g/liter. The granulated detergent particles were subjected to a treatment of increasing bulk density using a drum mixer with a Froude number of 0.3 and a rotational speed of 37 rpm for 60 minutes, to give detergent particles having a high bulk density with a bulk density of 897 g/liter. The composition of the granulated detergents, the conditions of the drum mixer, and the changes of the powder properties of the detergent particles having a high bulk density over the treatment time are shown in Table 5 and Table 6.

Comparative Example 1

The granulated detergent particles having a nonionic surfactant as a main component of the surfactant produced in Example 2 were used. The granulated detergent particles were supplied into a drum mixer in an amount of 18.1 kg at a volume packing fraction of 30%, the drum mixer having a cylindrical diameter of 400 mm, a cylindrical length of 600 mm, and a volume of 75.4 liters. Here, the bulk density of the granulated detergent particles was 800 g/liter. The granulated detergent particles were subjected to a treatment of increasing bulk density using a drum mixer with a Froude number of 0.07 and a rotational speed of 18 rpm for 60 minutes, to give nonionic detergent particles having a bulk density of 839 g/liter. The treatment with a low Froude number failed to increase the bulk density by 50 to 200 g/liter, so that the detergent particles having a high bulk density of the present invention were not able to be produced.

The composition of the granulated detergents, the conditions of the drum mixer, and the changes of the powder properties of the detergent particles having a high bulk density over the treatment time are shown in Table 5 and Table 6.

EXAMPLE 13

First, granulated detergent particles having an anionic surfactant as a main component of the surfactant were prepared. A slurry of detergent starting materials containing water in an amount of 50% by weight was spray-dried, to thereby give detergent particles having the compositions shown in Table 7.

The detergent particles thus obtained had an average particle size of 600 μm and a bulk density of 310 g/liter. One-hundred parts by weight of the detergent particles were supplied to a high-speed mixer FJG-GS-50J (manufactured by Fukae Powtec Corporation), and the detergent particles were stirred with the mixer having a main axis (190 rpm) and a chopper (1,500 rpm) for 10 minutes. Next, 2 parts by weight of water and 4 parts by weight of ZEOLITE 4A were added to the mixture, and the obtained mixture was stirred and granulated for 3 minutes. After taking the mixture out of the mixer, coarse grains were eliminated using a sieve with a 1410-μm-opening. Here, the entire charged amount was 20 kg. The granulated detergent particles having an anionic surfactant as a main component of the surfactant obtained by the above method were supplied into a drum mixer in an amount of 18.6 kg at a volume packing fraction of 30%, the drum mixer having a cylindrical diameter of 400 mm, a cylindrical length of 600 mm, and a volume of 75.4 liters. Here, the bulk density of the granulated detergent particles was 825 g/liter. The granulated detergent particles were subjected to a treatment of increasing bulk density using a drum mixer with a Froude number of 0.3 and a rotational speed of 37 rpm for 60 minutes, to give detergent particles having a high bulk density with a bulk density of 889 g/liter.

The composition of the granulated detergents, the conditions of the drum mixer, and the changes of the powder properties of the detergent particles having a high bulk density over the treatment time are shown in Table 7 and Table 8. It was found that there were substantially no changes in the average particle size and the amount of fine powder, indicating that substantially no granulated detergent particles were broken. Further, it was confirmed that the sphericity of the detergent particles were improved. In addition, it was confirmed that the surface smoothness factor became small, and the surface of the detergent particles became smooth. Also, substantially no adhesion of the detergent particles to the inside of the drum mixer took place, so that almost the entire amount, based on the charged amount, was recovered.

EXAMPLE 14

First, granulated detergent particles having an anionic surfactant as a main component of the surfactant were prepared. A slurry of detergent starting materials containing water in an amount of 50% by weight was spray-dried, to thereby give detergent particles having the compositions shown in Table 7.

The detergent particles thus obtained had an average particle size of 560 μm and a bulk density of 260 g/liter. One hundred parts by weight of the detergent particles were supplied to a high-speed mixer FJG-GS-50J (manufactured by Fukae Powtec Corporation), and the detergent particles were pulverized and granulated while stirring with the mixer having a main axis (190 rpm) and a chopper (1,500 rpm) for 15 minutes. Next, 4 parts by weight of ZEOLITE 4A were added and stirred in the same manner as above for 2 minutes to provide the surface improvement of the particles. After taking the mixture out of the mixer, coarse grains were eliminated using a sieve with a 1410-μm-opening. Here, the entire charged amount was 20 kg. The granulated detergent particles having an anionic surfactant as a main component of the surfactant obtained by the above method were supplied into a drum mixer in an amount of 16.9 kg at a volume packing fraction of 30%, the drum mixer having a cylindrical diameter of 400 mm, a cylindrical length of 600 mm, and a volume of 75.4 liters. Here, the bulk density of the granulated detergent particles was 745 g/liter. The granulated detergent particles were subjected to a treatment of increasing bulk density using a drum mixer with a Froude number of 0.3 and a rotational speed of 37 rpm for 60 minutes, to give detergent particles having a high bulk density with a bulk density of 799 g/liter. The composition of the granulated detergents, the conditions of the drum mixer, and the changes of the powder properties of the detergent particles having a high bulk density over the treatment time are shown in Table 7 and Table 8.

EXAMPLE 15

The granulated detergent particles having an anionic surfactant as a main component of the surfactant prepared in Example 14 were used. The granulated detergent particles were supplied into a drum mixer in an amount of 16.9 kg at a volume packing fraction of 30%, the drum mixer having a cylindrical diameter of 400 mm, a cylindrical length of 600 mm, and a volume of 75.4 liters. At the same time, ZEOLITE 4A (0.2 kg) was supplied as fine powder. Here, the bulk density of the granulated detergent particles was 745 g/liter, and the particles were heated to 50° C. before they were supplied into the mixer. The granulated detergent particles were subjected to a treatment of increasing bulk density using a drum mixer with a Froude number of 0.3 and a rotational speed of 37 rpm for 60 minutes, to give detergent particles having a high bulk density with a bulk density of 810 g/liter. The composition of the granulated detergents, the conditions of the drum mixer, and the changes of the powder properties of the detergent particles having a high bulk density over the treatment time are shown in Table 7 and Table 8.

EXAMPLE 16

The granulated detergent particles having an anionic surfactant as a main component of the surfactant prepared in Example 14 were used. The granulated detergent particles were supplied into a drum mixer in an amount of 16.9 kg at a volume packing fraction of 30%, the drum mixer having a cylindrical diameter of 400 mm, a cylindrical length of 600 mm, and a volume of 75.4 liters. Here, the bulk density of the granulated detergent particles was 745 g/liter, and the particles were heated to 50° C. before they were supplied into the mixer. The granulated detergent particles were subjected to a treatment of increasing bulk density using a drum mixer with a Froude number of 0.2 and a rotational speed of 30 rpm for 60 minutes, to give detergent particles having a high bulk density with a bulk density of 803 g/liter. The composition of the granulated detergents, the conditions of the drum mixer, and the changes of the powder properties of the detergent particles having a high bulk density over the treatment time are shown in Table 7 and Table 8.

EXAMPLE 17

The granulated detergent particles having an anionic surfactant as a main component of the surfactant prepared in Example 14 were used. The granulated detergent particles were supplied into a drum mixer in an amount of 16.9 kg at a volume packing fraction of 30%, the drum mixer having a cylindrical diameter of 400 mm, a cylindrical length of 600 mm, and a volume of 75.4 liters.

Here, the bulk density of the granulated detergent particles was 745 g/liter, and the particles were heated to 50° C. before they were supplied into the mixer. The granulated detergent particles were subjected to a treatment of increasing bulk density using a drum mixer with a Froude number of 0.5 and a rotational speed of 47 rpm for 60 minutes, to give detergent particles having a high bulk density with a bulk density of 815 g/liter. The composition of the granulated detergents, the conditions of the drum mixer, and the changes of the powder properties of the detergent particles having a high bulk density over the treatment time are shown in Table 7 and Table 8.

EXAMPLE 18

The granulated detergent particles having an anionic surfactant as a main component of the surfactant prepared in Example 14 were used. The granulated detergent particles were supplied into a drum mixer in an amount of 16.9 kg at a volume packing fraction of 30%, the drum mixer having a cylindrical diameter of 400 mm, a cylindrical length of 600 mm, and a volume of 75.4 liters. At the same time, ZEOLITE 4A (0.2 kg) was supplied as fine powder. Here, the bulk density of the granulated detergent particles was 745 g/liter, and the particles were heated to 50° C. before they were supplied into the mixer. The granulated detergent particles were subjected to a treatment of increasing bulk density using a drum mixer with a Froude number of 0.3 and a rotational speed of 37 rpm. At the same time, agitation impellers each having a shaft parallel to the center line of rotation of the drum mixer with a radius of 120 mm (0.6 times the distance to the innermost circumference of the drum mixer) was operated by stirring in a reverse direction of the cascading of the granulated detergent particles along the slant of the particle layer (in the same rotational direction as that of the drum mixer), the agitation impellers having a rotational speed of 160 rpm and a tip end speed of 2.0 m/s. After the drum mixer was operated for 40 minutes, detergent particles having a high bulk density with a bulk density of 819 g/liter were obtained. The composition of the granulated detergents, the conditions of the drum mixer, and the changes of the powder properties of the detergent particles having a high bulk density over the treatment time are shown in Table 9 and Table 10. When compared with Example 15, it was confirmed that the agitation impellers effectively served to shorten the time required for the treatment of increasing bulk density.

EXAMPLE 19

The granulated detergent particles having an anionic surfactant as a main component of the surfactant prepared in Example 14 were used. The granulated detergent particles were supplied into a drum mixer in an amount of 16.9 kg at a volume packing fraction of 30%, the drum mixer having a cylindrical diameter of 400 mm, a cylindrical length of 600 mm, and a volume of 75.4 liters. At the same time, ZEOLITE 4A (0.2 kg) was supplied as fine powder. Here, the bulk density of the granulated detergent particles was 745 g/liter, and the particles were heated to 50° C. before they were supplied into the mixer. The granulated detergent particles were subjected to a treatment of increasing bulk density using a drum mixer with a Froude number of 0.3 and a rotational speed of 37 rpm. At the same time, agitation impellers each having a shaft parallel to the center line of rotation of the drum mixer with a radius of 120 mm (0.6 times the distance to the innermost circumference of the drum mixer) was operated by stirring in a reverse direction of the cascading of the granulated detergent particles along the slant of the particle layer (in the same rotational direction as that of the drum mixer), the agitation impellers having a rotational speed of 280 rpm and a tip end speed of 3.5 m/s. After the drum mixer was operated for 20 minutes, detergent particles having a high bulk density with a bulk density of 818 g/liter were obtained.

The composition of the granulated detergents, the conditions of the drum mixer, and the changes of the powder properties of the detergent particles having a high bulk density over the treatment time are shown in Table 9 and Table 10. When compared with Example 15, it was confirmed that the agitation impellers effectively served to shorten the time required for the treatment of increasing bulk density.

EXAMPLE 20

The granulated detergent particles having an anionic surfactant as a main component of the surfactant prepared in Example 14 were used. The granulated detergent particles were supplied into a drum mixer in an amount of 16.9 kg at a volume packing fraction of 30%, the drum mixer having a cylindrical diameter of 400 mm, a cylindrical length of 600 mm, and a volume of 75.4 liters. At the same time, ZEOLITE 4A (0.2 kg) was supplied as fine powder. Also, 4 baffles with a height of 30 mm (0.15 times the rotation radius) were attached to the drum mixer over its full length. Here, the bulk density of the granulated detergent particles was 745 g/liter, and the particles were heated to 50° C. before they were supplied into the mixer. The granulated detergent particles were subjected to a treatment of increasing bulk density using a drum mixer with a Froude number of 0.3 and a rotational speed of 37 rpm. At the same time, agitation impellers each having a shaft parallel to the center line of rotation of the drum mixer with a radius of 120 mm (0.6 times the distance to the innermost circumference of the drum mixer) was operated by stirring in a reverse direction of the cascading of the granulated detergent particles along the slant of the particle layer (in the same rotational direction as that of the drum mixer), the agitation impellers having a rotational speed of 280 rpm and a tip end speed of 3.5 m/s. After the drum mixer was operated for 20 minutes, detergent particles having a high bulk density with a bulk density of 822 g/liter were obtained. The composition of the granulated detergents, the conditions of the drum mixer, and the changes of the powder properties of the detergent particles having a high bulk density over the treatment time are shown in Table 9 and Table 10. When compared with Example 15, it was confirmed that the agitation impellers effectively served to shorten the time required for the treatment of increasing bulk density. When compared with Example 19, it was also confirmed that attachment of the baffles further reduced the time required for the treatment of increasing bulk density.

EXAMPLE 21

The granulated detergent particles having an anionic surfactant as a main component of the surfactant produced in Example 14 were used. The granulated detergent particles were continuously supplied into a drum mixer (continuous type) having a cylindrical diameter of 600 mm, a cylindrical length of 1200 mm, and a volume of 339 liters. The size of the outlet of the drum mixer was adjusted in advance, to thereby have a volume packing fraction of 30%. The drum mixer was used without giving a tilt at the outlet side. The drum mixer was operated at a Froude number of 0.3 and a rotational speed of 30 rpm. At the same time, agitation impellers each having a shaft parallel to the center line of rotation of the drum mixer with a radius of 155 mm (0.52 times the distance to the innermost circumference of the drum mixer) was operated by stirring in a reverse direction of the cascading of the granulated detergent particles along the slant of the particle layer (in the same rotational direction as that of the drum mixer), the agitation impellers having a rotational speed of 216 rpm and a tip end speed of 3.5 m/s. Here, the bulk density of the granulated detergent particles was 745 g/liter, and the particles were heated to a temperature of 50° C. before they were supplied to the mixer.

When the granulated detergent particles were continuously supplied at 500 kg/hr, detergent particles having a high bulk density with a bulk density of 803 g/liter were obtained. It was found by measuring the amount of the granulated detergent particles residing in the drum mixer that the mean residence time of the granulated detergent particles in the drum mixer was about 10 minutes.

When the granulated detergent particles were continuously supplied at 250 kg/hr, detergent particles having a high bulk density with a bulk density of 820 g/liter were obtained. It was found by measuring the amount of the granulated detergent particles residing in the drum mixer that the mean residence time of the granulated detergent particles in the drum mixer was about 20 minutes.

When the granulated detergent particles were continuously supplied at 166 kg/hr, detergent particles having a high bulk density with a bulk density of 835 g/liter were obtained. It was found by measuring the amount of the granulated detergent particles residing in the drum mixer that the mean residence time of the granulated detergent particles in the drum mixer was about 30 minutes.

The composition of the granulated detergents, the conditions of the drum mixer, and the changes of the powder properties of the detergent particles having a high bulk density with respect to the mean residence time are shown in Table 9 and Table 10.

EXAMPLE 22

The granulated detergent particles having an anionic surfactant as a main component of the surfactant produced in Example 14 were used. The granulated detergent particles were continuously supplied into a drum mixer (continuous type) having a cylindrical diameter of 600 mm, a cylindrical length of 1200 mm, and a volume of 339 liters. The size of the outlet of the drum mixer was adjusted in advance, to thereby have a volume packing fraction of 30%. The drum mixer was tilted with an angle of 3° to lower the outlet side. The drum mixer was operated at a Froude number of 0.3 and a rotational speed of 30 rpm. At the same time, agitation impellers each having a shaft parallel to the center line of rotation of the drum mixer with a radius of 155 mm (0.52 times the distance to the innermost circumference of the drum mixer) was operated by stirring in a reverse direction of the cascading of the granulated detergent particles along the slant of the particle layer (in the same rotational direction as that of the drum mixer), the agitation impellers having a rotational speed of 153 rpm and a tip end speed of 2.5 m/s. Also, 4 disc-shaped partition plates, each partition plate with a diameter of 350 mm were attached to the center line of rotation of the drum at an interval of 240 mm, the partition plate being placed at a right angle to the center line of rotation of the drum. Here, the bulk density of the granulated detergent particles was 745 g/liter, and the particles were heated to a temperature of 50° C. before they were supplied to the mixer.

When the granulated detergent particles were continuously supplied at 500 kg/hr, detergent particles having a high bulk density with a bulk density of 805 g/liter were obtained. It was found by measuring the amount of the granulated detergent particles residing in the drum mixer that the mean residence time of the granulated detergent particles in the drum mixer was about 10 minutes.

When the granulated detergent particles were continuously supplied at 250 kg/hr, detergent particles having a high bulk density with a bulk density of 823 g/liter were obtained. It was found by measuring the amount of the granulated detergent particles residing in the drum mixer that the mean residence time of the granulated detergent particles in the drum mixer was about 20 minutes.

When the granulated detergent particles were continuously supplied at 166 kg/hr, detergent particles having a high bulk density with a bulk density of 838 g/liter were obtained. It was found by measuring the amount of the granulated detergent particles residing in the drum mixer that the mean residence time of the granulated detergent particles in the drum mixer was about 30 minutes.

The composition of the granulated detergents, the conditions of the drum mixer, and the changes of the powder properties of the detergent particles having a high bulk density with respect to the mean residence time are shown in Table 9 and Table 10.

EXAMPLE 23

The detergent particles produced in Example 14 were supplied into a high-speed mixer FJG-GS-50J (manufactured by Fukae Powtec Corporation) in an amount of 100 parts by weight, and the detergent particles were pulverized and granulated, while stirring the particles with the mixer having a main axis (190 rpm) and a chopper (1,500 rpm) for 17 minutes. Next, 4 parts by weight of ZEOLITE 4A were added and stirred in the same manner as above for 4 minutes to provide the surface improvement of the particles. After taking the mixture out of the mixer, coarse grains were eliminated using a sieve with a 1410-μm-opening. Here, the entire charged amount was 20 kg. The granulated detergent particles having an anionic surfactant as a main component of the surfactant obtained by the above method were supplied into a drum mixer in an amount of 17.2 kg at a volume packing fraction of 30%, the drum mixer having a cylindrical diameter of 400 mm, a cylindrical length of 600 mm, and a volume of 75.4 liters. Here, the bulk density of the granulated detergent particles was 762 g/liter, and the particles were heated to a temperature of 50° C. before they were supplied into the mixer. The granulated detergent particles were subjected to a treatment of increasing bulk density using a drum mixer with a Froude number of 0.3 and a rotational speed of 37 rpm for 60 minutes, to give detergent particles having a high bulk density. Around 40 minute after the start of the treatment of increasing bulk density, the granulated detergent particles were slightly aggregated, thereby showing an almost constant bulk density. Therefore, ZEOLITE 4A (0.4 kg) with an average particle size of 3 μm was mixed with the granulated detergent particles (17.2 kg). In this case, the bulk density of the granulated detergent particles was increased without causing aggregation. By a 60-minute treatment of increasing bulk density, the detergent particles having a high bulk density with a bulk density of 832 g/liter were obtained. The composition of the granulated detergents, the conditions of the drum mixer, and the changes of the powder properties of the detergent particles having a high bulk density over the treatment time are shown in Table 11 and Table 12.

EXAMPLE 24

First, granulated detergent particles having an anionic surfactant as a main component of the surfactant were prepared. A slurry of detergent starting materials containing water in an amount of 50% by weight was spray-dried, to thereby give detergent particles having the compositions shown in Table 13.

The detergent particles thus obtained had an average particle size of 510 μm and a bulk density of 310 g/liter. One hundred parts by weight of the detergent particles were supplied to a high-speed mixer FJG-GS-50J (manufactured by Fukae Powtec Corporation), and the detergent particles were pulverized and granulated while stirring with the mixer having a main axis (190 rpm) and a chopper (1,500 rpm) for 15 minutes. Next, 4 parts by weight of ZEOLITE 4A were added and stirred in the same manner as above for 2 minutes to provide the surface improvement of the particles. After taking the mixture out of the mixer, coarse grains were eliminated using a sieve with a 1410-μm-opening. Here, the entire charged amount was 20 kg. The granulated detergent particles having an anionic surfactant as a main component of the surfactant obtained by the above method were supplied into a drum mixer in an amount of 17.2 kg at a volume packing fraction of 30%, the drum mixer having a cylindrical diameter of 400 mm, a cylindrical length of 600 mm, and a volume of 75.4 liters. Here, the bulk density of the granulated detergent particles was 760 g/liter, and the particles were heated to a temperature of 50° C. before they were supplied into the mixer. The granulated detergent particles were subjected to a treatment of increasing bulk density using a drum mixer with a Froude number of 0.3 and a rotational speed of 37 rpm for 60 minutes, to give detergent particles having a high bulk density with a bulk density of 823 g/liter. The composition of the granulated detergents, the conditions of the drum mixer, and the changes of the powder properties of the detergent particles having a high bulk density over the treatment time are shown in Table 13 and Table 14.

EXAMPLE 25

First, granulated detergent particles having an anionic surfactant as a main component of the surfactant were prepared as follows: The starting materials in the following composition were supplied into an FM-NES-120 NES.KO-KNEADER (manufactured by Fuji Sangyo Co., Ltd.) in given amounts:

| | |
|---|---|
| Linear Alkylbenzenesulfonate (average carbon atoms of the alkyl group: 12, acid value: 187, water content: 0.7%, and free sulfuric acid: 3%) | 48 kg/hr |
| Alkyl Sulfate (mean carbon atoms of the alkyl group: 12.5) | 15 kg/hr |

-continued

| | |
|---|---|
| Anhydrous Light Ash (manufactured by Tosoh Corporation) | 60 kg/hr |
| 48% Aqueous Solution of Sodium Hydroxide | 4 kg/hr |
| Aqueous Solution of Sodium Silicate (molar ratio of No.2 $SiO_2/Na_2O$ = 2.5) | 5 kg/hr |

The mean residence time of the starting materials in a NES.KO-KNEADER was about 2 minutes. Alkyl sulfate was sulfated by a conventional method and then immediately used in testings in the present Examples at 40° C. The rest of the above starting materials were used at an ambient temperature.

The reaction mixture at 70° C. was discharged from the NES.KO-KNEADER and supplied to an extruder where the product was kneaded and then formed in a size of 8 mm square. The formed product was cooled to 30° C. on a fluidized bed to give the following composition:

| | | |
|---|---|---|
| LAS-Na (Linear Alkylbenzene-sulfonate) | 49.2 | 30.5 |
| AS-Na (Alky Sulfate) | 14.4 | 8.9 |
| Sodium Carbonate | 49.4 | 30.7 |
| Sodium Silicate | 2.5 | 1.6 |
| Unchanged Alcohol and Sodium Sulfate | 4.0 | 2.5 |
| Water | 9.4 | 5.8 |
| Total | 128.9 kg/hr | 80% |

20 parts by weight of powdery ZEOLITE 4A were mixed with 80 parts by weight of the above composition. The mixture was pulverized with a hammer mill to a size of not more than 1410 μm and granulated. 5 parts by weight of ZEOLITE 4A were further mixed with the granulated product in a FLEXOMIX (manufactured by Powrex Corporation).

The granulated detergent particles having an anionic surfactant as a main component of the surfactant obtained by the above method were supplied into a drum mixer in an amount of 17.1 kg at a volume packing fraction of 30%, the drum mixer having a cylindrical diameter of 400 mm, a cylindrical length of 600 mm, and a volume of 75.4 liters. Here, the bulk density of the granulated detergent particles was 755 g/liter, and the particles were heated to a temperature of 50° C. before they were supplied into the mixer. The granulated detergent particles were subjected to a treatment of increasing bulk density using a drum mixer with a Froude number of 0.3 and a rotational speed of 37 rpm for 60 minutes, to give detergent particles having a high bulk density with a bulk density of 811 g/liter. The composition of the granulated detergents, the conditions of the drum mixer, and the changes of the powder properties of the detergent particles having a high bulk density over the treatment time are shown in Table 13 and Table 14.

Comparative Example 2

The granulated detergent particles having an anionic surfactant as a main component of the surfactant produced in Example 14 were used. The granulated detergent particles were supplied into a drum mixer in an amount of 16.9 kg at a volume packing fraction of 30%, the drum mixer having a cylindrical diameter of 400 mm, a cylindrical length of 600 mm, and a volume of 75.4 liters. Here, the bulk density of the granulated detergent particles was 745 g/liter, and the particles were heated to a temperature of 50° C. before they were supplied into the mixer. The granulated detergent particles were subjected to a treatment of increasing bulk density using a drum mixer with a Froude number of 0.07 and a rotational speed of 18 rpm for 60 minutes, to give anion detergent particles having a bulk density of 781 g/liter. The treatment with a low Froude number failed to increase the bulk density by 50 to 200 g/liter, so that the detergent particles having a high bulk density of the present invention were not able to be produced. The composition of the granulated detergents, the conditions of the drum mixer, and the changes of the powder properties of the detergent particles having a high bulk density over the treatment time are shown in Table 11 and Table 12.

TABLE 1

| | Example 1 | Example 2 | Example 3 | Example 4 | Example 5 |
|---|---|---|---|---|---|
| Composition of Granulated Detergent [kg] | | | | | |
| Sodium Carbonate*3 | 0.0<br>0.0% | 10.5<br>35.0% | 19.0<br>63.5% | 10.5<br>35.0% | 10.5<br>35.0% |
| Amorphous Aluminosilicate*2 | 8.7<br>29.0% | 5.1<br>17.0% | 2.6<br>8.5% | 5.1<br>17.0% | 5.1<br>17.0% |
| Nonionic Surfactant*1 | 15.3<br>51.0% | 9.0<br>30.0% | 4.5<br>15.0% | 9.0<br>30.0% | 9.0<br>30.0% |
| ZEOLITE 4A*4 (for surface improvement) | 6.0<br>20.0% | 5.4<br>18.0% | 3.9<br>13.0% | 5.4<br>18.0% | 5.4<br>18.0% |
| Powder Temperature upon Supplying to Mixer [°C.] | 25 | 25 | 25 | 25 | 25 |
| Type of Mixer | Drum Mixer | Drum Mixer | Drum Mixer | Drum Mixer | Drum Mixer |
| Batch/Continuous | Batch | Batch | Batch | Batch | Batch |
| Froude Number [–] | 0.3 | 0.3 | 0.3 | 0.2 | 0.5 |
| Volume of Mixer [l] | 75.4 | 75.4 | 75.4 | 75.4 | 75.4 |
| Volume Packing Fraction [%] | 30 | 30 | 30 | 30 | 30 |
| Charged Amount [kg] | 15.3 | 18.1 | 20.5 | 18.1 | 18.1 |
| Agitation Impeller | None | None | None | None | None |
| Tip End Speed of Agitation Impeller [m/sec] | — | — | — | — | — |

TABLE 1-continued

| | Example 1 | Example 2 | Example 3 | Example 4 | Example 5 |
|---|---|---|---|---|---|
| Charged Amount of Fine Particle ZEOLITE 4A*[4] [kg] | 0.0 | 0.0 | 0.2 | 0.0 | 0.0 |

*[1]Polyoxyethylene dodecyl ether (average molar number of ethylene oxide adduct = 8; melting point 15° C.; HLB 10.14).
*[2]Amorphous aluminosilicate 0.8 $Na_2O.Al_2O_3.6.5\ SiO_2$.
Microporous capacity 310 $cm^3$/100 g; Specific surface area 153 $m^2$/g; Amount of oil absorbed 245 ml/100 g.
*[3]DENSE PARTICLE ASH, manufactured by Tosoh Corporation; Average particle size 280 μm.
*[4]Manufactured by Tosoh Corporation; Average particle size 3 μm.

TABLE 2

| | Example 1 | Example 2 | Example 3 | Example 4 | Example 5 |
|---|---|---|---|---|---|
| Before Treatment of Increasing Bulk Density | | | | | |
| Average Particle Size [μm] | 400 | 405 | 410 | 405 | 405 |
| Amount of Fine Powder [%] | 3.0 | 1.5 | 1.2 | 1.5 | 1.5 |
| Degree of Sphericity [%] | 136 | 145 | 163 | 145 | 145 |
| Surface Smoothness Factor [μm] | 1.62 | 1.60 | 1.57 | 1.60 | 1.60 |
| Bulk Density [g/l] | 675 | 800 | 905 | 800 | 800 |
| Fluidity [sec] | 6.8 | 6.8 | 6.8 | 6.8 | 6.8 |
| After 10-Minute Treatment of Increasing Bulk Density | | | | | |
| Bulk Density [g/l] | 695 | 835 | 976 | 829 | 840 |
| Fluidity [sec] | 6.3 | 6.4 | 6.4 | 6.5 | 6.3 |
| After 20-Minute Treatment of Increasing Bulk Density | | | | | |
| Bulk Density [g/l] | 710 | 858 | 988 | 850 | 861 |
| Fluidity [sec] | 6.2 | 6.3 | 6.2 | 6.3 | 6.3 |
| After 30-Minute Treatment of Increasing Bulk Density | | | | | |
| Bulk Density [g/l] | 720 | 872 | 1000 | 863 | 878 |
| Fluidity [sec] | 6.1 | 6.1 | 6.0 | 6.0 | 6.0 |
| After 40-Minute Treatment of Increasing Bulk Density | | | | | |
| Bulk Density [g/l] | 724 | 882 | 1005 | 876 | 885 |
| Fluidity [sec] | 5.9 | 6.0 | 6.0 | 5.9 | 6.0 |
| After 60-Minute Treatment of Increasing Bulk Density | | | | | |
| Average Particle Size [μm] | 410 | 401 | 402 | 404 | 400 |
| Amount of Fine Powder [%] | 0.5 | 0.9 | 0.9 | 1.0 | 0.9 |
| Degree of Sphericity [%] | 132 | 141 | 160 | 142 | 141 |
| Surface Smoothness Factor [μm] | 0.75 | 0.75 | 0.74 | 0.81 | 0.72 |
| Bulk Density [g/l] | 730 | 888 | 1015 | 883 | 891 |
| Fluidity [sec] | 5.8 | 5.9 | 5.9 | 6.0 | 5.9 |
| Ratio of Increasing Bulk Density* [%] | 8.1 | 11.0 | 12.2 | 10.3 | 11.14 |

$$* \frac{\left[\begin{array}{c}\text{Bulk density after}\\ \text{60-Minute Treatment}\end{array} - \begin{array}{c}\text{Bulk Density}\\ \text{before Treatment}\end{array}\right]}{\left[\begin{array}{c}\text{Bulk density}\\ \text{before Treatment}\end{array}\right]} \times 100$$

TABLE 3

| | Example 6 | Example 7 | Example 8 | Example 9 | Example 10 |
|---|---|---|---|---|---|
| Composition of Granulated Detergent [kg] | | | | | |
| Sodium Carbonate*[3] | 10.5<br>35.0% | 10.5<br>35.0% | 10.5<br>35.0% | 10.5<br>35.0% | 10.5<br>35.0% |

TABLE 3-continued

| | Example 6 | Example 7 | Example 8 | Example 9 | Example 10 |
|---|---|---|---|---|---|
| Amorphous Aluminosilicate*2 | 5.1<br>17.0% | 5.1<br>17.0% | 5.1<br>17.0% | 5.1<br>17.0% | 5.1<br>17.0% |
| Nonionic Surfactant*1 | 9.0<br>30.0% | 9.0<br>30.0% | 9.0<br>30.0% | 9.0<br>30.0% | 9.0<br>30.0% |
| ZEOLITE 4A*4 | 5.4<br>18.0% | 5.4<br>18.0% | 5.4<br>18.0% | 5.4<br>18.0% | 5.4<br>18.0% |
| Powder Temperature upon Supplying to Mixer [°C.] | 25 | 25 | 25 | 25 | 25 |
| Type of Mixer | Drum Mixer Equipped with Agitation Impeller | Drum Mixer Equipped with Agitation Impeller | Drum Mixer Equipped with Agitation Impeller*6 | Drum Mixer Equipped with Agitation Impeller | Drum Mixer Equipped with Agitation Impeller*7 |
| Batch/Continuous*5 | Batch | Batch | Batch | Cont. | Cont. |
| Froude Number [−] | 0.3 | 0.3 | 0.3 | 0.3 | 0.3 |
| Volume of Mixer [l] | 75.4 | 75.4 | 75.4 | 339 | 339 |
| Volume Packing Fraction [%] | 30 | 30 | 30 | 30 | 30 |
| Charged Amount [kg] | 18.1 | 18.1 | 18.1 | — | — |
| Agitation Impeller | Equipped | Equipped | Equipped | Equipped | Equipped |
| Tip End Speed of Agitation Impeller [m/sec] | 1.0 | 3.0 | 3.0 | 2.5 | 2.5 |
| Charged Amount of Fine Particle ZEOLITE 4A*4 | 0.0 | 0.0 | 0.2 | 0.0 | 0.0 |

*1Polyoxyethylene dodecyl ether (average molar number of ethylene oxide adduct = 8; melting point 15° C.; HLB 10.14).
*2Amorphous aluminosilicate 0.8 $Na_2O.Al_2O_3.6.5\ SiO_2$.
Microporous capacity 310 $cm^3$/100 g; Specific surface area 153 $m^2$/g; Amount of oil absorbed 245 ml/100 g.
*3DENSE PARTICLE ASH, manufactured by Tosoh Corporation; Average particle size 280 μm.
*4Manufactured by Tosoh Corporation; Average particle size 3 μm.
*5In case of continuous process, the treatment time for increasing bulk density indicates mean residence time.
*6Equipped with baffles.
*7Equipped with partition plates.

TABLE 4

| | Example 6 | Example 7 | Example 8 | Example 9 | Example 10 |
|---|---|---|---|---|---|
| Before Treatment of Increasing Bulk Density | | | | | |
| Average Particle Size [μm] | 405 | 405 | 405 | 405 | 405 |
| Amount of Fine Powder [%] | 1.5 | 1.5 | 1.5 | 1.5 | 1.5 |
| Degree of Sphericity [%] | 145 | 145 | 145 | 145 | 145 |
| Surface Smoothness Factor [μm] | 1.60 | 1.60 | 1.60 | 1.60 | 1.60 |
| Bulk Density [g/l] | 800 | 800 | 800 | 800 | 800 |
| Fluidity [sec] | 6.8 | 6.8 | 6.8 | 6.8 | 6.8 |
| After 10-Minute Treatment of Increasing Bulk Density | | | | | |
| Bulk Density [g/l) | 843 | 848 | 855 | 850 | 852 |
| Fluidity [sec] | 6.4 | 6.3 | 6.2 | 6.3 | 6.2 |
| After 20-Minute Treatment of Increasing Bulk Density | | | | | |
| Bulk Density [g/l] | 865 | 872 | 882 | 873 | 876 |
| Fluidity [sec] | 6.2 | 6.1 | 6.0 | 6.0 | 6.0 |
| After 30-Minute Treatment of Increasing Bulk Density | | | | | |
| Bulk Density [g/l] | 883 | 888 | 889 | 887 | 889 |
| Fluidity [sec] | 6.0 | 6.0 | 6.0 | 6.0 | 5.9 |
| After 40-Minute Treatment of Increasing Bulk Density | | | | | |
| Bulk Density [g/l] | 888 | 889 | 890 | — | — |
| Fluidity [sec] | 5.9 | 5.9 | 5.9 | — | — |
| After 60-Minute Treatment of Increasing Bulk Density*8 | | | | | |
| Average Particle Size [μm] | 403 | 401 | 399 | 400 | 401 |
| Amount of Fine Powder [%] | 0.9 | 0.8 | 0.8 | 0.8 | 0.7 |
| Degree of Sphericity [%] | 141 | 141 | 140 | 140 | 139 |

TABLE 4-continued

| | Example 6 | Example 7 | Example 8 | Example 9 | Example 10 |
|---|---|---|---|---|---|
| Surface Smoothness Factor [μm] | 0.78 | 0.75 | 0.74 | 0.74 | 0.74 |
| Bulk Density [g/l] | 889 | 889 | 890 | — | — |
| Fluidity [sec] | 5.9 | 5.9 | 5.9 | — | — |
| Ratio of Increasing Bulk Density* [%] | 11.1 | 11.1 | 11.3 | — | — |

$$* \frac{\left[\text{Bulk density after 60-Minute Treatment} - \text{Bulk Density before Treatment}\right]}{\left[\text{Bulk density before Treatment}\right]} \times 100$$

*[8]The powder property values after 60-minute treatment of increasing bulk density for Examples 9 and 10 are results for those having mean residence time of 30 minutes.

TABLE 5

| | Example 11 | | Example 12 | Compara. Example 1 |
|---|---|---|---|---|
| Composition of Granulated Detergent [kg] | | | | |
| Sodium Carbonate*[3] | 11.14<br>38.0% | | 11.1<br>37.0% | 10.5<br>35.0% |
| Amorphous Aluminosilicate*[2] | 5.1<br>17.0% | | 5.6<br>18.7% | 5.1<br>17.0% |
| Nonionic Surfactant*[1] | 9.0<br>30.0% | | 6.9<br>23.0% | 9.0<br>30.0% |
| Fatty Acid (Palmitic Acid) | —<br>— | | 1.4<br>4.7% | —<br>— |
| ZEOLITE 4A*[4] | —<br>— | | 2.8<br>9.3% | —<br>— |
| ZEOLITE 4A*[4] (for surface improvement) | 4.5<br>15.0% | | 2.2<br>7.3% | 5.4<br>18.0% |
| Powder Temperature upon Supplying to Mixer [°C.] | 25 | | 25 | 25 |
| Type of Mixer | Drum Mixer | Drum Mixer | Drum Mixer | Drum Mixer |
| Batch/Continuous | Batch | Batch | Batch | Batch |
| Froude Number [–] | 0.3 | 0.3 | 0.3 | 0.07 |
| Volume of Mixer [l] | 75.4 | 75.4 | 75.4 | 75.4 |
| Volume Packing Fraction [%] | 30 | 30 | 30 | 30 |
| Charged Amount [kg] | 18.7 | 18.7 | 18.8 | 18.1 |
| Agitation Impeller | None | None | None | None |
| Tip End Speed of Agitation Impeller [m/sec] | — | — | — | — |
| Charged Amount of | 0.0 | 0.4 | 0.0 | 0.0 |

TABLE 5-continued

| | Example 11 | Example 12 | Compara. Example 1 |
|---|---|---|---|
| Fine Particle ZEOLITE 4A*[4] [kg] | | | |

*[1]Poloxyethylene dodecyl ether (average molar number of ethylene oxide adduct = 8; melting point 15° C.; HLB 10.14).

*[2]Amorphous aluminosilicate 0.8 $Na_2O.Al_2O_3.6.5\ SiO_2$.

Microporous capacity 310 $cm^3/100$ g; Specific surface area 153 $m^2/g$; Amount of oil absorbed 245 ml/100 g.

In case of Example 12: Amorphous aluminosilicate $Na_2O.Al_2O_3.3\ SiO_2$.

Microporous capacity 245 $cm^3/100$ g; Specific surface area 64 $m^2/g$; Amount of oil absorbed 180 ml/100 g.

*[3]DENSE PARTICLE ASH, manufactured by Tosoh Corporation; Average particle size 280 μm

*[4]Manufactured by Tosoh Corporation; Average particle size 3 μm.

TABLE 6

| | Example 11 | | Example 12 | Compara. Example 1 |
|---|---|---|---|---|
| Before Treatment of Increasing Bulk Density | | | | |
| Average Particle Size [μm] | 420 | 420 | 420 | 405 |
| Amount of Fine Powder [%] | 1.1 | 1.1 | 1.8 | 1.5 |
| Degree of Sphericity [%] | 142 | 142 | 151 | 145 |
| Surface Smoothness Factor [μm] | 1.55 | 1.55 | 1.61 | 1.60 |
| Bulk Density [g/l] | 828 | 828 | 830 | 800 |
| Fluidity [sec] | 6.5 | 6.5 | 6.9 | 6.8 |
| After 10-Minute Treatment of Increasing Bulk Density | | | | |
| Bulk Density [g/l] | 871 | 862 | 854 | 814 |
| Fluidity [sec] | 6.2 | 6.3 | 6.6 | 6.7 |

TABLE 6-continued

| | Example 11 | | Example 12 | Compara. Example 1 |
|---|---|---|---|---|
| After 20-Minute Treatment of Increasing Bulk Density | | | | |
| Bulk Density [g/l] | 870 | 871 | 862 | 822 |
| Fluidity [sec] | 6.3 | 6.3 | 6.5 | 6.7 |
| After 30-Minute Treatment of Increasing Bulk Density | | | | |
| Bulk Density [g/l] | 874 | 880 | 878 | 828 |
| Fluidity [sec] | 6.3 | 6.2 | 6.2 | 6.6 |
| After 40-Minute Treatment of Increasing Bulk Density | | | | |
| Bulk Density [g/l] | 877 | 886 | 890 | 833 |
| Fluidity [sec] | 6.3 | 6.1 | 6.0 | 6.6 |
| After 60-Minute Treatment of Increasing Bulk Density | | | | |
| Average Particle Size [μm] | 415 | 410 | 418 | 401 |
| Amount of Fine Powder [%] | 0.8 | 0.9 | 1.6 | 1.2 |
| Degree of Sphericity [%] | 139 | 138 | 149 | 144 |
| Surface Smoothness Factor [μm] | 0.73 | 0.74 | 0.80 | 1.25 |
| Bulk Density [g/l] | 879 | 890 | 897 | 839 |
| Fluidity [sec] | 6.3 | 6.0 | 6.0 | 6.5 |
| Ratio of Increasing Bulk Density* [%] | 6.2 | 7.5 | 8.1 | 4.9 |

$$* \frac{\left[\begin{array}{c}\text{Bulk density after}\\ \text{60-Minute Treatment}\end{array} - \begin{array}{c}\text{Bulk Density}\\ \text{before Treatment}\end{array}\right]}{\left[\begin{array}{c}\text{Bulk density}\\ \text{before Treatment}\end{array}\right]} \times 100$$

TABLE 7

| | Example 13 | Example 14 | Example 15 | Example 16 | Example 17 |
|---|---|---|---|---|---|
| Composition of Granulated Detergent [parts by weight] | | | | | |
| Spray-Dried Product | | | | | |
| Linear Alkylbenzenesulfonate | 35 | 25 | 25 | 25 | 25 |
| Alkyl Sulfate | 10 | 10 | 10 | 10 | 10 |
| Nonionic Surfactant*1 | 3.5 | 3 | 3 | 3 | 3 |
| Soap | — | 3 | 3 | 3 | 3 |
| Sodium Carbonate*2 | 21.5 | 10 | 10 | 10 | 10 |
| Sodium Silicate | 7 | 15 | 15 | 15 | 15 |
| Sodium Sulfate | 3 | 1 | 1 | 1 | 1 |
| ZEOLITE 4A*3 | 14 | 25 | 25 | 25 | 25 |
| Polyethylene Glycol 6000*4 | — | 2 | 2 | 2 | 2 |
| Water | 6 | 6 | 6 | 6 | 6 |
| Added upon Granulation | | | | | |
| ZEOLITE 4A*3 | 4 | 4 | 4 | 4 | 4 |
| Water | 2 | — | — | — | — |
| Powder Temperature upon Supplying to Mixer [°C.] | 25 | 25 | 50 | 50 | 50 |
| Type of Mixer | Drum Mixer | Drum Mixer | Drum Mixer | Drum Mixer | Drum Mixer |
| Batch/Continuous | Batch | Batch | Batch | Batch | Batch |
| Froude Number [−] | 0.3 | 0.3 | 0.3 | 0.2 | 0.5 |
| Volume of Mixer [l] | 75.4 | 75.4 | 75.4 | 75.4 | 75.4 |
| Volume Packing Fraction [%] | 30 | 30 | 30 | 30 | 30 |
| Charged Amount [kg] | 18.6 | 16.9 | 16.9 | 16.9 | 16.9 |
| Agitation Impeller | None | None | None | None | None |
| Peripheral Speed of Agitation Impeller [m/sec] | — | — | — | — | — |

TABLE 7-continued

| | Example 13 | Example 14 | Example 15 | Example 16 | Example 17 |
|---|---|---|---|---|---|
| Charged Amount of Fine Particle ZEOLITE 4A*3 [kg] | 0.0 | 0.0 | 0.2 | 0.0 | 0.0 |

*1Polyoxyethylene dodecyl ether (average molar number of ethylene oxide adduct = 8; melting point 15° C.; HLB 10.14).
*2DENSE PARTICLE ASH, manufactured by Tosoh Corporation; Average particle size 280 μm.
*3Manufactured by Tosoh Corporation; Average particle size 3 μm.
*4KPEG manufactured by Kao Corporation.

TABLE 8

| | Example 13 | Example 14 | Example 15 | Example 16 | Example 17 |
|---|---|---|---|---|---|
| Before Treatment of Increasing Bulk Density | | | | | |
| Average Particle Size [μm] | 345 | 430 | 430 | 430 | 430 |
| Amount of Fine Powder [%] | 4.9 | 4.4 | 4.4 | 4.4 | 4.4 |
| Degree of Sphericity [%] | 159 | 161 | 161 | 161 | 161 |
| Surface Smoothness Factor [μm] | 1.80 | 1.85 | 1.85 | 1.85 | 1.85 |
| Bulk Density [g/l] | 825 | 745 | 745 | 745 | 745 |
| Fluidity [sec] | 6.8 | 6.9 | 6.9 | 6.9 | 6.9 |
| After 10-Minute Treatment of Increasing Bulk Density | | | | | |
| Bulk Density [g/l] | 848 | 766 | 782 | 776 | 789 |
| Fluidity [sec] | 6.6 | 6.5 | 6.6 | 6.8 | 6.6 |
| After 20-Minute Treatment of Increasing Bulk Density | | | | | |
| Bulk Density [g/l] | 862 | 773 | 798 | 788 | 802 |
| Fluidity [sec] | 6.4 | 6.4 | 6.5 | 6.6 | 6.4 |
| After 30-Minute Treatment of Increasing Bulk Density | | | | | |
| Bulk Density [g/l] | 871 | 775 | 806 | 800 | 808 |
| Fluidity [sec] | 6.4 | 6.5 | 6.4 | 6.5 | 6.3 |
| After 40-Minute Treatment of Increasing Bulk Density | | | | | |
| Bulk Density [g/l] | 880 | 779 | 807 | 801 | 813 |
| Fluidity [sec] | 6.3 | 6.4 | 6.2 | 6.3 | 6.2 |
| After 60-Minute Treatment of Increasing Bulk Density | | | | | |
| Average Particle Size [μm] | 310 | 421 | 434 | 433 | 436 |
| Amount of Fine Powder [%] | 4.7 | 4.8 | 4.6 | 4.5 | 4.6 |
| Degree of Sphericity [%] | 156 | 159 | 157 | 158 | 157 |
| Surface Smoothness Factor [μm] | 0.90 | 0.89 | 0.78 | 0.85 | 0.77 |
| Bulk Density [g/l] | 889 | 799 | 810 | 803 | 815 |
| Fluidity [sec] | 6.2 | 6.3 | 6.2 | 6.3 | 6.2 |
| Ratio of Increasing Bulk Density* [%] | 7.8 | 7.2 | 8.7 | 7.8 | 9.4 |

$$* \frac{\left[\begin{array}{c}\text{Bulk density after}\\ \text{60-Minute Treatment}\end{array} - \begin{array}{c}\text{Bulk Density}\\ \text{before Treatment}\end{array}\right]}{\left[\begin{array}{c}\text{Bulk density}\\ \text{before Treatment}\end{array}\right]} \times 100$$

TABLE 9

| | Example 18 | Example 19 | Example 20 | Example 21 | Example 22 |
|---|---|---|---|---|---|
| Composition of Granulated Detergent [parts by weight] Spray-Dried Product | | | | | |
| Linear Alkylbenzenesulfonate | 25 | 25 | 25 | 25 | 25 |
| Alkyl Sulfate | 10 | 10 | 10 | 10 | 10 |
| Nonionic Surfactant*1 | 3 | 3 | 3 | 3 | 3 |

TABLE 9-continued

| | Example 18 | Example 19 | Example 20 | Example 21 | Example 22 |
|---|---|---|---|---|---|
| Soap | 3 | 3 | 3 | 3 | 3 |
| Sodium Carbonate*[2] | 10 | 10 | 10 | 10 | 10 |
| Sodium Silicate | 15 | 15 | 15 | 15 | 15 |
| Sodium Sulfate | 1 | 1 | 1 | 1 | 1 |
| ZEOLITE 4A*[3] | 25 | 25 | 25 | 25 | 25 |
| Polyethylene Glycol 6000*[4] | 2 | 2 | 2 | 2 | 2 |
| Water | 6 | 6 | 6 | 6 | 6 |
| Added upon Granulation ZEOLITE 4A*[3] | 4 | 4 | 4 | 4 | 4 |
| Powder Temperature upon Supplying to Mixer [°C.] | 50 | 50 | 50 | 50 | 50 |
| Type of Mixer | Drum Mixer Equipped with Agitation Impeller | Drum Mixer Equipped with Agitation Impeller | Drum Mixer Equipped with Agitation Impeller*[5] | Drum Mixer Equipped with Agitation Impeller | Drum Mixer Equipped with Agitation Impeller*[6] |
| Batch/Continuous | Batch | Batch | Batch | Cont. | Cont. |
| Froude Number [−] | 0.3 | 0.3 | 0.3 | 0.3 | 0.3 |
| Volume of Mixer [l] | 75.4 | 75.4 | 75.4 | 339 | 339 |
| Volume Packing Fraction [%] | 30 | 30 | 30 | 30 | 30 |
| Charged Amount [kg] | 16.9 | 16.9 | 16.9 | — | — |
| Agitation Impeller | Equipped | Equipped | Equipped | Equipped | Equipped |
| Peripheral Speed of Agitation Impeller [m/sec] | 2.0 | 3.5 | 3.5 | 3.5 | 2.5 |
| Charged Amount of Fine Particle ZEOLITE 4A*[3] [kg] | 0.2 | 0.2 | 0.2 | 0.0 | 0.0 |

*[1]Polyoxyethylene dodecyl ether (average molar number of ethylene oxide adduct = 8; melting point 15° C.; HLB 10.14).
*[2]DENSE PARTICLE ASH, Manufactured by Tosoh Corporation; Average particle size 280 μm
*[3]Manufactured by Tosoh Corporation; Average particle size 3 μm.
*[4]KPEG manufactured by Kao Corporation.
*[5]Equipped with baffles.
*[6]Equipped with partition plates.

TABLE 10

| | Example 18 | Example 19 | Example 20 | Example 21 | Example 22 |
|---|---|---|---|---|---|
| Before Treatment of Increasing Bulk Density | | | | | |
| Average Particle Size [μm] | 430 | 430 | 430 | 430 | 430 |
| Amount of Fine Powder [%] | 4.4 | 4.4 | 4.4 | 4.4 | 4.4 |
| Degree of Sphericity [%] | 161 | 161 | 161 | 161 | 161 |
| Surface Smoothness Factor [μm] | 1.85 | 1.85 | 1.85 | 1.85 | 1.85 |
| Bulk Density [g/l] | 745 | 745 | 745 | 745 | 745 |
| Fluidity [sec] | 6.9 | 6.9 | 6.9 | 6.9 | 6.9 |
| After 10-Minute Treatment of Increasing Bulk Density | | | | | |
| Bulk Density [g/l] | 798 | 802 | 809 | 803 | 805 |
| Fluidity [sec] | 6.4 | 6.3 | 6.2 | 6.4 | 6.3 |
| After 20-Minute Treatment of Increasing Bulk Density | | | | | |
| Bulk Density [g/l] | 813 | 818 | 822 | 820 | 823 |
| Fluidity [sec] | 6.2 | 6.2 | 6.1 | 6.3 | 6.2 |
| After 30-Minute Treatment of Increasing Bulk Density | | | | | |
| Bulk Density [g/l] | 817 | 834 | 837 | 835 | 838 |
| Fluidity [sec] | 6.2 | 6.3 | 6.1 | 6.3 | 6.2 |
| After 40-Minute Treatment of Increasing Bulk Density | | | | | |
| Bulk Density [g/l] | 819 | 835 | 838 | — | — |
| Fluidity [sec] | 6.1 | 6.1 | 6.0 | — | — |
| After 60-Minute Treatment of Increasing Bulk Density | | | | | |
| Average Particle Size [μm] | 436 | 439 | 437 | 439 | 435 |
| Amount of Fine Powder [%] | 4.7 | 4.9 | 5.0 | 4.5 | 4.6 |
| Degree of Sphericity [%] | 156 | 155 | 154 | 155 | 154 |

TABLE 10-continued

| | Example 18 | Example 19 | Example 20 | Example 21 | Example 22 |
|---|---|---|---|---|---|
| Surface Smoothness Factor [μm] | 0.77 | 0.75 | 0.74 | 0.76 | 0.74 |
| Bulk Density [g/l] | 822 | 835 | 838 | — | — |
| Fluidity [sec] | 6.1 | 6.1 | 6.1 | | |
| Ratio of Increasing Bulk Density* [%] | 10.3 | 12.1 | 12.4 | — | — |

$$* \frac{\left[\begin{array}{c}\text{Bulk density after}\\ \text{60-Minute Treatment}\end{array} - \begin{array}{c}\text{Bulk Density}\\ \text{before Treatment}\end{array}\right]}{\left[\begin{array}{c}\text{Bulk density}\\ \text{before Treatment}\end{array}\right]} \times 100$$

*7The powder property values after 60-minute treatment of increasing bulk density for Examples 21 and 22 are results for those having mean residence time of 30 minutes.

TABLE 11

| | Example 23 | | Compara. Example 2 |
|---|---|---|---|
| Composition of Granulated Detergent [parts by weight] | | | |
| Spray-Dried Product | | | |
| Linear Alkylbenzenesulfonate | 25 | | 25 |
| Alkyl Sulfate | 10 | | 10 |
| Nonionic Surfactant*1 | 3 | | 3 |
| Soap | 3 | | 3 |
| Sodium Carbonate*3 | 10 | | 10 |
| Sodium Silicate | 15 | | 15 |
| Sodium Sulfate | 1 | | 1 |
| ZEOLITE 4A*4 | 25 | | 25 |
| Polyethylene glycol 6000*2 | 2 | | 2 |
| Water | 6 | | 6 |
| Added upon Granulation | | | |
| ZEOLITE 4A*4 | 4 | | 4 |
| Water | — | | — |
| Powder Temperature upon Supplying to Mixer [°C.] | 50 | 50 | 50 |
| Type of Mixer | Drum Mixer | Drum Mixer | Drum Mixer |

TABLE 11-continued

| | Example 23 | | Compara. Example 2 |
|---|---|---|---|
| Batch/Continuous | Batch | Batch | Batch |
| Froude Number [–] | 0.3 | 0.3 | 0.07 |
| Volume of Mixer [l] | 75.4 | 75.4 | 75.4 |
| Volume Packing Fraction [%] | 30 | 30 | 30 |
| Charged Amount [kg] | 17.2 | 17.2 | 16.9 |
| Agitation Impeller | None | None | None |
| Peripheral Speed of Agitation Impeller [m/sec] | — | — | — |
| Charged Amount of Fine Particle ZEOLITE 4A*4 [kg] | 0.0 | 0.4 | 0.0 |

*1 Polyoxyethylene dodecyl ether (average molar number of ethylene oxide adduct = 8; melting point 15° C.; HLB 10.14).

*2KPEG manufactured by Kao Corporation.

*3DENSE PARTICLE ASH, Manufactured by Tosoh Corporation; Average particle size 280 μm

*4Manufactured by Tosoh Corporation; Average particle size 3 μm.

TABLE 12

| | Example 23 | | Compara. Example 2 |
|---|---|---|---|
| Before Treatment of Increasing Bulk Density | | | |
| Average Particle Size [μm] | 442 | 442 | 430 |
| Amount of Fine Powder [%] | 4.0 | 4.0 | 4.4 |
| Degree of Sphericity [%] | 156 | 156 | 161 |
| Surface Smoothness Factor [μm] | 1.78 | 1.78 | 1.85 |
| Bulk Density [g/l] | 762 | 762 | 745 |
| Fluidity [sec] | 6.8 | 6.8 | 6.9 |
| After 10-Minute Treatment of Increasing Bulk Density | | | |
| Bulk Density [g/l] | 784 | 782 | 758 |
| Fluidity [sec] | 6.6 | 6.7 | 6.7 |

TABLE 12-continued

| | Example 23 | | Compara. Example 2 |
|---|---|---|---|
| After 20-Minute Treatment of Increasing Bulk Density | | | |
| Bulk Density [g/l] | 802 | 800 | 763 |
| Fluidity [sec] | 6.5 | 6.5 | 6.6 |
| After 30-Minute Treatment of Increasing Bulk Density | | | |
| Bulk Density [g/l] | 810 | 815 | 771 |
| Fluidity [sec] | 6.4 | 6.3 | 6.5 |
| After 40-Minute Treatment of Increasing Bulk Density | | | |
| Bulk Density [g/l] | 816 | 823 | 778 |
| Fluidity [sec] | 6.4 | 6.3 | 6.4 |
| After 60-Minute Treatment of Increasing Bulk Density | | | |
| Average Particle Size [μm] | 439 | 440 | 432 |
| Amount of Fine Powder [%] | 3.9 | 4.2 | 4.5 |
| Degree of Sphericity [%] | 154 | 152 | 160 |
| Surface Smoothness Factor [μm] | 0.98 | 0.77 | 1.35 |
| Bulk Density [g/l] | 817 | 832 | 781 |
| Fluidity [sec] | 6.4 | 6.2 | 6.4 |
| Ratio of Increasing Bulk Density* [%] | 7.2 | 9.2 | 4.8 |

$$* \frac{\left[\begin{array}{c}\text{Bulk density after}\\ \text{60-Minute Treatment}\end{array} - \begin{array}{c}\text{Bulk Density}\\ \text{before Treatment}\end{array}\right]}{\left[\begin{array}{c}\text{Bulk density}\\ \text{before Treatment}\end{array}\right]} \times 100$$

TABLE 13

| Composition of Granulated Detergent [parts by weight] | Example 24 (Spray-Dried Product) | Example 25 (Formed Product) |
|---|---|---|
| Linear Alkylbenzenesulfonate | 25 | 30.5 |
| Alkyl Sulfate | 10 | 8.9 |
| Nonionic Surfactant*1 | — | — |
| Soap | 3 | — |
| Sodium Carbonate*2 | 13 | 30.7 |
| Sodium Silicate | 15 | 1.6 |
| Sodium Sulfate | 1 | 2.5*4 |
| ZEOLITE 14A*3 | 25 | — |
| Polyethylene Glycol 6000 | 2 | — |
| Water | 6 | 5.8 |
| Added upon Pulverization and Granulation ZEOLITE 4A*3 | 4 | 20 |
| Added upon Mixing ZEOLITE 4A*3 | — | 5 |
| Powder Temperature upon Supplying to Mixer [C.] | 50 | 50 |
| Type of Mixer | Drum Mixer | Drum Mixer |
| Batch/Continuous | Batch | Batch |
| Froude Number [−] | 0.3 | 0.3 |
| Volume of Mixer [l] | 75.4 | 75.4 |

TABLE 13-continued

| | Example 24 | Example 25 |
|---|---|---|
| Volume Packing Fraction [%] | 30 | 30 |
| Charged Amount [kg] | 17.2 | 17.1 |
| Agitation Impeller | None | None |
| Peripheral Speed of Agitation Impeller [m/sec] | — | — |
| Charged Amount of Fine Particle ZEOLITE 4A*3 [kg] | 0.0 | 0.0 |

*1Polyoxyethylene dodecyl ether (average molar number of ethylene oxide adduct = 8; melting point 15° C.; HLB 10.14).

*2Example 24: DENSE PARTICLE ASH, manufactured by Tosoh Corporation; Average particle size 280 μm.

Example 25 : LIGHT ASH, manufactured by Tosoh Corporation; Average particle size 85 μm.

*3Manufactured by Tosoh Corporation; Average particle size 3 μm.

*4Containing unchanged alcohol.

TABLE 14

| | Example 24 | Example 25 |
|---|---|---|
| Before Treatment of Increasing Bulk Density | | |
| Average Particle Size [μm] | 415 | 455 |
| Amount of Fine Powder [%] | 4.1 | 4.8 |
| Degree of Sphericity [%] | 157 | 169 |
| Surface Smoothness Factor [μm] | 1.82 | 1.90 |
| Bulk Density [g/l] | 760 | 755 |
| Fluidity [sec] | 6.8 | 7.0 |
| After 10-Minute Treatment of Increasing Bulk Density | | |
| Bulk Density [g/l] | 781 | 768 |
| Fluidity [sec] | 6.6 | 6.8 |
| After 20-Minute* Treatment of Increasing Bulk Density | | |
| Bulk Density [g/l] | 796 | 782 |
| Fluidity [sec] | 6.4 | 6.5 |
| After 30-Minute Treatment of Increasing Bulk Density | | |
| Bulk Density [g/l] | 811 | 794 |
| Fluidity [sec] | 6.3 | 6.4 |
| After 40-Minute Treatment of Increasing Bulk Density | | |
| Bulk Density [g/l] | 820 | 805 |
| Fluidity [sec] | 6.2 | 6.3 |
| After 60-Minute Treatment of Increasing Bulk Density | | |
| Average Particle Size [μm] | 410 | 450 |
| Amount of Fine Powder [%] | 4.3 | 4.9 |
| Degree of Sphericity [%] | 155 | 164 |
| Surface Smoothness Factor [μm] | 0.79 | 0.82 |
| Bulk Density [g/l] | 823 | 811 |
| Fluidity [sec] | 6.1 | 6.2 |
| Ratio of Increasing Bulk Density* [%] | 8.3 | 7.4 |

$$* \frac{\left[\begin{array}{c}\text{Bulk density after}\\ \text{60-Minute Treatment}\end{array} - \begin{array}{c}\text{Bulk Density}\\ \text{before Treatment}\end{array}\right]}{\left[\begin{array}{c}\text{Bulk density}\\ \text{before Treatment}\end{array}\right]} \times 100$$

INDUSTRIAL APPLICABILITY

According to the production method using a drum mixer of the present invention, it is possible to increase the bulk density of the detergent particles by 50 to 200 g/liter, wherein the granulated detergent particles or that of the granulated detergent particles subjected to a treatment of increasing bulk density by conventional methods have a bulk density of from 500 to 1,000 g/liter.

We claim:

1. A method for producing detergent particles comprising mixing granulated detergent particles having a bulk density of from 500 to 1,000 g/liter, while applying a shearing force to particles caused by mutual contact of the particles in a rotary vessel mixer under conditions having a Froude number of from 0.2 to 0.7 and a volume packing fraction of from 15 to 50%, the Froude number being defined by an equation given below:

$$Fr=V^2/(R\times g)$$

wherein Fr stands for a Froude number; V stands for a peripheral speed of the outermost circumference of the rotary vessel mixer; R stands for a radius from a center of rotation of the outermost circumference of the rotary vessel mixer; and g stands for a gravitational acceleration, to thereby increase the bulk density of said granulated detergent particles by 50 to 200 g/liter and to thereby improve sphericity and/or surface smoothness of said granulated detergent particles.

2. The production method according to claim 1, wherein the granulated detergent particles comprise a nonionic surfactant or an anionic surfactant.

3. The production method according to claim 2, wherein the content of the nonionic surfactant is from 5 to 60% by weight of the granulated detergent particles.

4. The production method according to claim 2, wherein the content of the anionic surfactant is from 5 to 60% by weight of the granulated detergent particles.

5. The production method according to claim 2, wherein the granulated detergent particles comprise an anionic surfactant and are heated to a temperature of not less than 35° C. and mixed, while applying a shearing force.

6. The production method according to claim 1, wherein the detergent particles having a high bulk density are continuously produced by continuously supplying the granulated detergent particles to the rotary vessel mixer.

7. The production method according to claim 1, wherein the rotary vessel mixer is equipped with agitation impellers in an inner portion thereof, a rotational radius of the agitation impellers being not more than 0.8 times a rotational radius of the rotary vessel mixer, and wherein agitation is carried out at a tip end speed of the agitation impellers of from 1 to 6 m/s.

8. The production method according to claim 1, wherein particles having an average primary particle diameter of not more than 10 μm are added in an amount of from 0.1 to 10.0 parts by weight, based on 100 parts by weight of the granulated detergent particles.

9. The production method according to claim 1, wherein a surface smoothness factor of the granulated detergent particles is not more than 70% of an initial surface smoothness factor thereof.

10. The production method according to claim 1, wherein the rotary vessel mixer is equipped with plural partition plates arranged perpendicular to the center line of rotation of the vessel, the partition plates being attached in the direction of the center line of rotation.

11. The production method according to claim 7, wherein the agitation impellers are rod-shaped impellers or plate-like impellers, the agitation impellers being arranged in parallel to the center line of rotation of the rotary vessel mixer.

12. The production method according to claim 1, wherein the rotary vessel mixer is a drum mixer.

* * * * *